US008096100B2

(12) United States Patent
Greenwald et al.

(10) Patent No.: US 8,096,100 B2
(45) Date of Patent: Jan. 17, 2012

(54) SYSTEMS AND METHODS FOR PACKAGING SOLID PHARMACEUTICAL AND/OR NUTRACEUTICAL PRODUCTS AND AUTOMATICALLY ARRANGING THE SOLID PHARMACEUTICAL AND NUTRACEUTICAL PRODUCTS IN A LINEAR TRANSMISSION SYSTEM

(75) Inventors: Shlomo Greenwald, Ithaca, NY (US); Zipora Greenwald, Ithaca, NY (US)

(73) Assignee: Greenwald Technologies LLC, Ithaca, NY (US)

( * ) Notice: Subject to any disclaimer, the term of this patent is extended or adjusted under 35 U.S.C. 154(b) by 0 days.

(21) Appl. No.: 11/509,244

(22) Filed: Aug. 23, 2006

(65) Prior Publication Data

US 2007/0044432 A1 Mar. 1, 2007

(51) Int. Cl.
*B65B 35/34* (2006.01)

(52) U.S. Cl. ..... 53/544; 53/446; 53/151; 53/147

(58) Field of Classification Search ..... 53/443–447, 53/428, 437, 111 R, 525, 147, 151, 152–153, 53/544

See application file for complete search history.

(56) References Cited

U.S. PATENT DOCUMENTS

| | | | | |
|---|---|---|---|---|
| 2,577,394 | A | 12/1951 | Zunino | |
| 2,809,768 | A * | 10/1957 | Pollmann et al. | 221/68 |
| 3,129,544 | A | 4/1964 | Klapes et al. | |
| 3,537,230 | A | 11/1970 | Dorfmann | |
| 3,730,388 | A | 5/1973 | Bender | |
| 3,774,368 | A | 11/1973 | Paprzycki et al. | |
| 4,460,108 | A * | 7/1984 | Noda et al. | 221/94 |
| 4,480,982 | A * | 11/1984 | Sexstone et al. | 425/385 |
| 4,614,263 | A * | 9/1986 | Nagata et al. | 198/418.3 |
| 5,101,612 | A | 4/1992 | Yamamoto et al. | |
| 5,525,023 | A * | 6/1996 | Soga et al. | 414/414 |
| 5,829,632 | A | 11/1998 | Gehlert et al. | |
| 5,992,611 | A | 11/1999 | Cosgrove | |
| 6,073,800 | A | 6/2000 | Saito et al. | |
| 6,298,976 | B1 | 10/2001 | David | |
| 6,308,861 | B1 * | 10/2001 | Saito et al. | 221/212 |
| 6,336,573 | B1 * | 1/2002 | Johanson | 222/412 |
| 6,405,895 | B1 * | 6/2002 | Kondo et al. | 221/236 |
| 6,443,669 | B2 * | 9/2002 | Saito | 406/28 |
| 6,497,083 | B1 | 12/2002 | Garwood et al. | |

* cited by examiner

*Primary Examiner* — Christopher Harmon
(74) *Attorney, Agent, or Firm* — Robert J. Depke; Rockey, Depke & Lyons, LLC

(57) ABSTRACT

A variety of systems and methods are described which quickly and conveniently provide for the selective transmission of individual solid pharmaceutical products from a common location into individual blister package product cavities. In accordance with the preferred exemplary embodiments, an automated alignment mechanism alters the orientation of solid pharmaceutical products that are initially arranged randomly in a two-dimensional array into one or more linear transmission systems. Each linear transmission system is essentially a one-dimensional stack of solid pharmaceutical products, vitamins or other elements. In accordance with another aspect of the present invention, after the solid pharmaceutical products have been arranged in one or more of the linear transmission systems or vertical stacks, the solid pharmaceutical products are selectively transmitted into individual product package blister cavities or into product package templates having locations corresponding to the blister package cavities.

10 Claims, 15 Drawing Sheets

SYSTEMS AND METHODS FOR PACKAGING SOLID PHARMACEUTICAL AND/OR NUTRACEUTICAL PRODUCTS AND AUTOMATICALLY ARRANGING THE SOLID PHARMACEUTICAL AND NUTRACEUTICAL PRODUCTS IN A LINEAR TRANSMISSION SYSTEM

BACKGROUND OF THE INVENTION

1. Field of the Invention

The present invention relates generally to the field of automated solid pharmaceutical packaging systems. More specifically, the present invention is directed to automated systems and methods for arranging solid pharmaceutical products in a linear transmission system for the selective transmission of individual solid pharmaceuticals, medications or vitamins.

2. Description of the Related Art

Currently, there are wide variety of known solid pharmaceutical product packaging systems and methods. These conventional packaging and dispensing systems and methods rely upon a variety of different techniques for selectively transmitting one or more solid pharmaceutical products into a package. For example, some of these known systems and methods utilize individual automated dispensing canisters provided in an array such that the array of canisters is arranged to selectively transmit a variety of different pharmaceutical products into a package via a common funnel. Typically, these known conventional systems rely upon a vertically stacked arrangement of the automated dispensing canisters so that a gravity feed path may be provided from the canisters to the common funnel.

One such known system is described in U.S. Pat. No. 7,185,476. This conventional system provides a funnel that receives the individual solid pharmaceutical products which are selectively transmitted from the individual canisters of the array. The funnel is then selectively located over either a blister package cavity or a temporary storage mechanism that subsequently drops the solid pharmaceutical product into the desired package cavity of a typical blister package. The blister package cavities are subsequently sealed and provided to individual patients.

Another conventional system for selectively packaging pharmaceutical products relies upon the use of a robotic arm for selectively locating a desired automated solid pharmaceutical product dispensing canister at a location corresponding to a solid pharmaceutical product blister package cavity. The robotic arm is programmed to selectively access the automated dispensing canisters which are provided in an array surrounding the robotic anti for convenient access. When the robotic arm positions one of more dispensing canisters above locations corresponding to blister package cavities, the automated dispensing canisters are triggered to release the solid pharmaceutical product into a blister package cavity or package template. Although the known conventional systems have provided a reliable mechanism for automatically packaging solid pharmaceutical products, there are several remaining shortcomings associated with these existing systems.

First, in regard to the systems and methods which utilize a common funnel for initially receiving a plurality of solid pharmaceutical products, there is a noticeable delay associated with the time that it takes for an individual solid pharmaceutical product to transit into its desired location for a blister package cavity from the canister via the funnel. Furthermore, these known systems require additional time for aligning the funnel with respect to its desired location relative to the destination blister package cavity. Although the known systems are significantly faster and more accurate than other conventional techniques, there is always a demand for increases in throughput which typically correlate with a reduction in cost for the packaging operation.

As mentioned above, another packaging technique is the use of a robotic arm to selectively locate one or more automated dispensing canisters at a location corresponding to the desired solid pharmaceutical blister package cavity for placement of the solid pharmaceutical product. Although this approach also improves productivity, this known technique requires that the automated robotic arm physically move each canister from a temporary storage location to the location of each blister package cavity into which the solid pharmaceutical product is to be dispensed. The cumulative transit time that is required for selectively grabbing and moving each automated dispensing canister to the desired location for packaging the solid pharmaceutical products is also significant.

In the United States and throughout the world, as the aging population increases, there is a corresponding if not greater increase in the demand for patient medications. Consequently, there is an ever increasing demand for pharmaceutical packaging products which are both extremely accurate and fast. Although the existing conventional systems quickly and accurately fill solid pharmaceutical product packages, there remains a need for improved throughput and greater efficiencies in the pharmaceutical packaging systems.

Accordingly, one object of the present invention is to provide systems and methods for automatically filling blister packages with solid pharmaceutical products both quickly and accurately. Another object of the present invention is to provide a direct transmission path from a temporary storage location for a plurality of specific solid pharmaceutical products into a desired blister package cavity. Another object and advantage of the present invention is to provide systems and methods which can provide greater throughput over existing conventional automated solid pharmaceutical packaging systems and methods. Other objects and advantages of the present invention will be apparent in light of the following summary and detailed description of the presently preferred embodiments.

SUMMARY OF THE INVENTION

In accordance with the present invention, a variety of systems and methods are described which quickly and conveniently provide for the selective transmission of individual solid pharmaceutical products from a common location into individual blister package product cavities. In accordance with the preferred exemplary embodiments, an automated alignment mechanism alters the orientation of solid pharmaceutical products that are initially arranged randomly in a two-dimensional array into one or more linear transmission systems. Each linear transmission system is essentially a one-dimensional stack of solid pharmaceutical products, vitamins or other elements. In accordance with another aspect of the present invention, after the solid pharmaceutical products have been arranged in one or more of the linear transmission systems or vertical stacks, the solid pharmaceutical products are selectively transmitted into individual product package blister cavities or into product package templates having locations corresponding to the blister package cavities.

In a first preferred exemplary embodiment, the random two-dimensional orientation of the solid products is advantageously provided in a temporary storage compartment that is comprised of two planar panels defining a cavity therebetween. It is preferred that at least one or both of the planar members are comprised of a clear plastic material so that an individual operating the packaging machinery can readily visually examine the processing and transmission of a plurality of solid pharmaceutical products. Those skilled in the art will appreciate that the planar arrangement of the panels is preferred in order to provide an initial two-dimensional orientation of the product so that the pills or other solid products can be readily oriented in a linear fashion for transmission through the linear transmission channel.

The inventors of the instant application have discovered that greater operating efficiencies and speed can be achieved by initially providing a two-dimensional arrangement of the solid pharmaceutical products prior to transitioning into a one-dimensional arrangement for convenient dispensation of the solid pharmaceutical products into a blister package cavity. As noted in more detail below, other arrangements are also possible.

In accordance with the preferred exemplary embodiment two-dimensional funnels are formed within the cavity defined by the two planar panels. The funnels are preferably wedge shaped members having a thickness which is slightly smaller than the width of the cavity holding the solid pharmaceutical products in a two-dimensional array. In accordance with the preferred exemplary embodiment, an automated shaking mechanism displaces one or more of the wedge shaped members upward and downward in the cavity holding the two-dimensional array of solid pharmaceutical products. In accordance with the preferred exemplary embodiment, the wedge-shaped members are mounted on one or more mechanical guides and are in contact with springs located at the base of the wedge-shaped members that bias the wedge-shaped members into an uppermost position of their range of motion. The precise arrangement of the mechanical guides and the springs which drive the wedge-shaped members are described in more detail below.

A drive motor rotates the drive shaft having one or more cam members with mechanical contacts that physically displace each of the wedge-shaped members downward against mechanical force of the spring. Once the mechanical contact of the cam member is no longer in contact with a mechanical catch associated with the wedge member, one or more springs associated with the wedge member quickly forces the wedge member upwardly into the cavity containing the two-dimensional array of solid pharmaceutical products. The initial downward and subsequent rapid upward motion of the wedge member rapidly pushes solid pharmaceutical that are located above the wedge member upward and away from the linear transmission channel located at the bottom of the funnel defined by two adjacent wedge members. This downward and upward physical displacement and the two-dimensional funnel defined by the adjacent wedge shaped members quickly and conveniently aligns the solid pharmaceutical products so that they readily fall into the linear transmission channels that are located at the bottom of each funnel. Any blockage of the funnel occasioned by the random orientation of the solid pharmaceutical products is quickly eliminated and the linear transmission channels are rapidly filled with the solid pharmaceutical products.

In accordance with the presently preferred exemplary embodiment, the two-dimensional cavity defined by the panel members preferably includes a plurality of wedge members generally arranged at a common horizontal position between the panels. The arrangement of the adjacent wedge-shaped members defines a plurality of two-dimensional funnels. Each of the two-dimensional funnels is located within the cavity. The funnels defined by the adjacent wedge shaped members directly feed into a corresponding linear transmission channel for the solid pharmaceutical products.

The linear transmission channels provide a one-dimensional arrangement of the solid pharmaceutical products for convenient selective dispensing of the product from the linear transmission channels into a product package cavity. In accordance with the preferred exemplary embodiment, it is preferred that a single drive motor and drive shaft located adjacent to the two-dimensional solid pharmaceutical product package cavity includes a plurality of cam members each with a corresponding mechanical contact that drives a corresponding wedge shaped member. In the preferred exemplary embodiment, one static wedge-shaped member is located adjacent to one of the wedge-shaped members that is physically displaced downward and upward into the cavity having a two-dimensional array of solid pharmaceutical products. Those skilled in the art will appreciate that it is also possible to have each of the wedge shaped members move as described above.

Although a variety of different arrangements are possible, it is preferred that the mechanical displacement of each of the wedge-shaped members for a single two-dimensional array of solid pharmaceutical products is arranged to be slightly out of phase from one another so that the instantaneous load on the drive motor is reduced. More specifically, in the preferred exemplary embodiment, a plurality of static and moving wedge-shaped members are provided across the bottom of the two-dimensional cavity containing the random arrangement of solid pharmaceutical products. In utilizing such approach, every static wedge-shaped member may be separated by intervening wedge shaped members which are physically displaced in the cavity. For the sake of convenience and due to space constraints, typically the outermost wedge-shaped members (defining one half of the outermost funnel) are static and thereafter the remaining wedges are alternating static and dynamic.

Those skilled in the art will appreciate that a variety of different mechanical drives and arrangements are possible for making and using the present invention and that the specific arrangement described in the instant application is only the preferred approach and currently contemplated best mode of making and using the present invention. For example, it is contemplated that a variety of different drive mechanisms may be used to displace the wedge shaped members. Specifically, although a spring biased mechanical motion is described which relies upon an electric drive motor having cam members which temporarily displace the wedge-shaped members against the mechanical spring bias, it is contemplated that pneumatic drives or other electric solenoid type drives or alternate motor drive arrangements may also be utilized for the purpose of downwardly and upwardly displacing the wedge shaped members in accordance with the present invention. When using pneumatic drives or electric solenoid mechanisms for displacing the wedge shaped members, the direction of the wedge motion is changed so that initially the wedge members are moved upward against springs and the springs return the wedge-shaped members to their original position in a downward direction.

Furthermore, although it is preferred to rely upon the release of spring energy for vertically displacing the wedge-shaped members, it should be recognized that the particular mechanism through which the displacement of one or more wedge-shaped members is achieved is not important and that virtually any known mechanical drive will work to achieve the desired orientation.

As noted above, the preferred two-dimensional funnel members that are defined by the panels and the wedge-shaped members feed into linear transmission channels that are provided in correspondence with each funnel. The linear transmission channels are preferably arranged vertically beneath a corresponding funnel and may be comprised of a channel that is defined by a plastic or metal tube. When the linear transmission channels are constructed as a tube, the tube may be either cylindrical or rectangular and preferably includes wings or spacers which position the individual solid pharmaceuticals in a stack separated from the internal side walls of the tube member. The wings are essentially protrusions from the internal sidewall of the tube. Alternatively, the linear transmission channel may be defined by a plurality of metal or plastic rods which define the channel for stacking a plurality of solid pharmaceutical products. The model or plastic rods operate in similar fashion to the wings or protrusions in the linear channels and maintain the solid products in a linear array.

In accordance with a further alternate preferred embodiment, each of the linear transmission channels may be defined by a metallic spring within which a plurality of the solid products are stacked. The inventors have discovered that the use of a spring for defining the linear channel is particularly suitable for preventing gel caps from sticking to the sidewalls of the linear transmission channels. When a metallic spring is used to define an individual linear transmission channel, it is preferred that the spring be gently mechanically vibrated when the individual solid pharmaceuticals are being transferred through the linear transmission channel in order to prevent the solid pharmaceutical products from getting stuck within the linear transmission channels.

In accordance with another aspect of the present invention, a plurality of alternate unique mechanical escapement mechanisms are provided to assure the rapid and convenient selective transmission of a single solid pharmaceutical product from the linear transmission channels as desired. For example, in accordance with the first alternate exemplary embodiment of the escapement mechanism, a horizontal drive selectively toggles upper and lower solid pharmaceutical product catch mechanisms which ensure that only one solid pharmaceutical product is delivered as desired from the linear transmission channel.

During operation of the device, initially the lowermost catch mechanism prevents the lowest solid pharmaceutical product from escaping the linear transmission channel. The toggling action of this device thereafter selectively positions the uppermost catch to be in contact with the next solid pharmaceutical product in the linear transmission channel thereby preventing all remaining solid pharmaceutical products in the linear transmission channel from moving downward. When the upper catch mechanism moves into contact with the next solid pharmaceutical product in the linear transmission channel, the lowermost catch mechanism is moved away from the lowest solid pharmaceutical product remaining in the channel thereby allowing the lowermost solid pharmaceutical product to drop from the channel into either a blister package cavity or a temporary storage mechanism socially with a blister package cavity.

The toggling action of the device thereafter moves the lower catch mechanism back into the channel and the upper catch is moved away from the channel thereby enabling all solid pharmaceutical products within the channel to drop by one position such that the remaining lowermost solid pharmaceutical products moves into contact with the lowermost catch mechanism. The toggling action of the device thereby enables the selective dropping of the solid pharmaceutical product or vitamin from the linear transmission channel into a solid pharmaceutical product package cavity or temporary storage mechanism. Alternate embodiments are described which conveniently provide the toggling action of the upper and lower catch mechanisms via the displacement of a single mechanical structure. The displacement may be either a vertical motion or a horizontal motion which thereby provides the desired toggling action of the escapement mechanism.

Triggering of the toggling action for the escapement mechanism may be achieved in a variety of different manners such as, for example, via the use of an electronic solenoid, an electric motor drive, or a pneumatic drive. Those skilled in the art will appreciate that the specific mechanical actuator is not critical to the operation of the device.

In accordance with a preferred exemplary embodiment of the present invention, the funnels and linear transmission channels having corresponding escapement mechanisms are preferably provided in either a one-dimensional or two-dimensional array. It is particularly preferred that the exit locations for the solid pharmaceutical products correspond with desired locations of a corresponding blister package cavity or temporary storage mechanism associated with locations corresponding to a blister package cavity. The inventors have discovered that dramatic increases in packaging efficiency and speed can be achieved by utilizing one or more arrays of the described dispensing mechanisms for filling solid pharmaceutical product packaging.

For example, a one-dimensional linear array having funnels and linear transmission channels corresponding to each member of a complete row of blister package cavities in a solid pharmaceutical product package can be utilized to simultaneously fill each cavity or the location of a product package template corresponding to each cavity in the row. More specifically, in such embodiment, the escapement mechanism for each linear transmission channel can be triggered at the same time to simultaneously fill each row. In yet another alternate embodiment, a matrix of funnels and linear transmission channels corresponding to a plurality of rows of blister package cavities or corresponding to all rows of cavities in a blister package can be provided. In such an alternate embodiment, either the same or different medications may be provided in the array in order to simultaneously fill all cavities with the same medications or alternatively to selectively locate different medications from positions in the array into desired product package cavities or the locations of a package template corresponding to the blister package cavities.

According to another aspect of the present invention, a conveyor is provided for the purpose of moving blister package cavities beneath one or more arrays of the above-described dispensing mechanisms in order to provide greater flexibility in the different types of medications that may be inserted into the blister package cavities for patient use. For example, by providing a single row that is filled with a common type of medication, the only limitation placed upon the number of different medications that can be inserted into the blister package cavities is the number of different types of medications contained in rows of the dispensing mechanisms. Specifically, as many as 400 or more rows of dispensing mechanisms may be provided in arrangement such that the conveyor positions the blister package cavities or a package template corresponding to the locations of the blister package cavities beneath each desired row. Such an arrangement would provide a system that is capable of filling virtually any type of medication that is typically desired or used in a normal hospital or managed care facility.

Yet another alternate aspect of the present invention is directed to the use of a pre-filled magazine containing a two-dimensional random array of the solid pharmaceutical products. Advantageously, the pre-filled magazine may be conveniently placed directly over the cavity within which the wedge shaped members are positioned. A sliding door located at the bottom of the pre-filled magazine is opened in order to allow the medications to freely move into position above the wedge shaped members so that the solid pharmaceutical products may be rearranged from a two-dimensional random array into a one-dimensional linear stack for placement into individual package cavities as described above. The pre-filled magazines may be manually filled or an automated system may be provided for filling the magazines.

In accordance with yet another alternate aspect of the present invention, a three-dimensional funnel is provided such that two or more distinct portions define the three-dimensional funnel structure. In such an embodiment, at least one portion of the funnel structure is vertically displaced for the purpose of altering the three-dimensional random orientation of solid pharmaceutical products within the funnel into a linear transmission channel. This approach uses the same general concept as the motion of the wedge-shaped members within the two-dimensional cavity for orienting the solid pharmaceutical products but it does not require an initial step of arranging the solid pharmaceutical products in a two-dimensional cavity.

Although not described in the provisional application upon which the instant application relies for its priority claim, the inventors of the instant application have subsequently collaborated with other inventors for the purpose of developing a convenient mechanism for arranging solid pharmaceutical products in a two-dimensional cavity from a three-dimensional store. For the sake of completeness, the currently contemplated structures for this mechanism are also described.

BRIEF DESCRIPTION OF THE DRAWINGS

FIG. 6 B illustrates a cross-sectional view of the linear transmission channel or tube of FIG. 6 A;

FIG. 12 B illustrates the batch door when located within the recess illustrated in FIG. 12 A;

DETAILED DESCRIPTION OF THE PRESENTLY PREFERRED EMBODIMENTS

Figure 1:
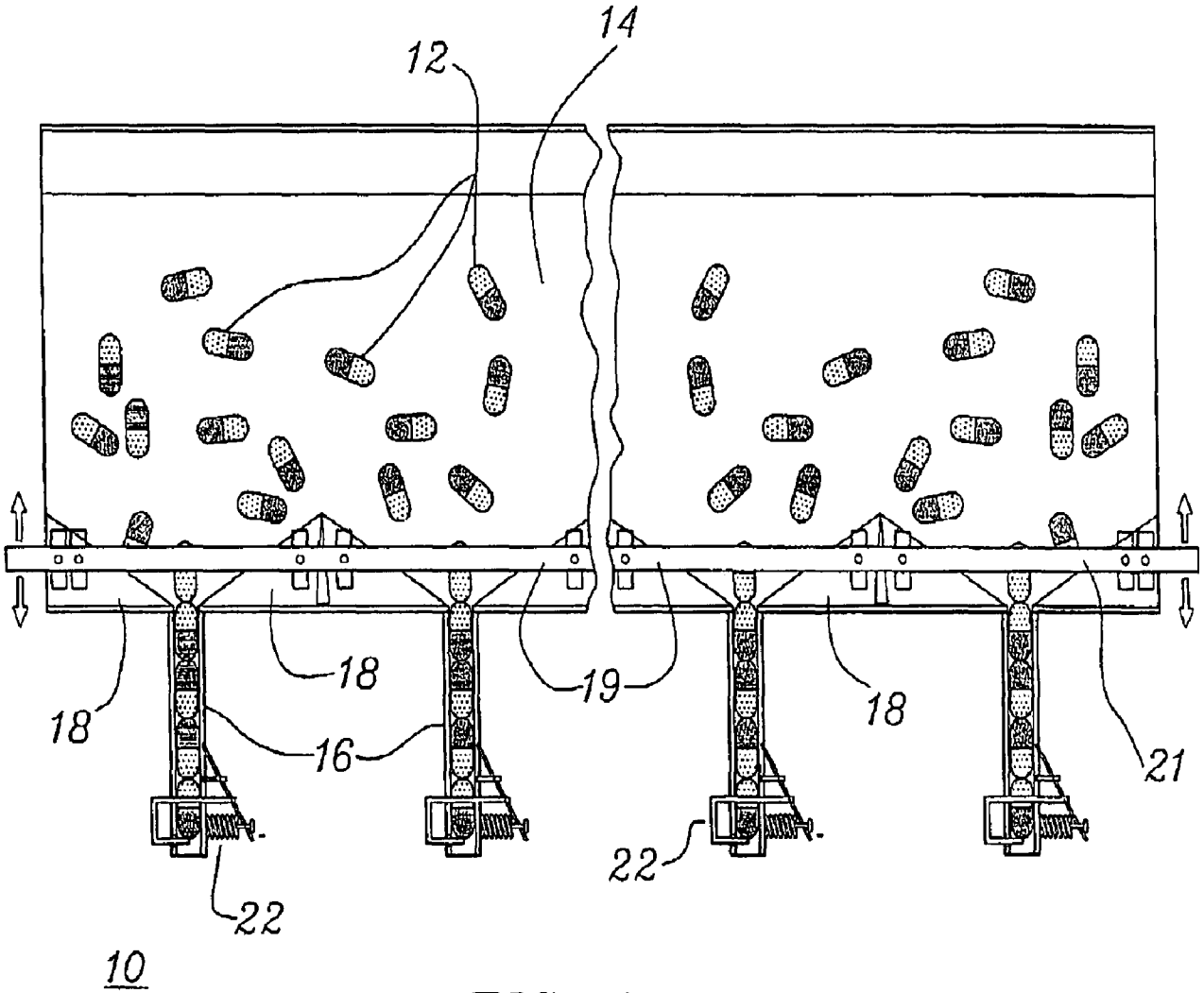
FIG. 1 illustrates a first preferred exemplary embodiment which demonstrates an arrangement for translating a two-dimensional random arrangement of solid pharmaceuticals or other products into a one-dimensional array or stack.

FIG. 1 illustrates a first exemplary embodiment of the present invention which is shown generally at 10. In accordance with the preferred exemplary embodiment, an automated alignment mechanism alters the orientation of solid pharmaceutical products that are initially arranged randomly in a two-dimensional array into one or more linear transmission systems. A plurality of solid pharmaceutical products 12 are randomly arranged in a two-dimensional array within a cavity that is formed between two generally planar structures. The cavity 14 containing the random two-dimensional array of solid pharmaceutical products is located above a plurality of linear transmission systems 16. Each linear transmission system 16 provides a one-dimensional stack of solid pharmaceutical products, vitamins, nutraceuticals or other elements.

In accordance with the alternate design of the present invention described in FIG. 1, a plurality of wedge-shaped members 18 are shaken by a shaking bar 19 which mechanically displaces the wedge-shaped members 18 up-and-down into the random two-dimensional array of solid pharmaceutical products 12. Those skilled in the art will recognize that a variety of different mechanical drives may be provided for generating the vertical displacement of the wedge shaped members 18. For example, pneumatic drives, electrically driven solenoid drives or electric motors may be used for physically moving the wedge shaped members 18 in the cavity 14. A more detailed description of the preferred mechanical drive for displacing the wedge-shaped members 18 is described below. Although FIG. 1 illustrates each of the wedge-shaped members being agitated via a common connecting bar 21, it is preferred that wedge members that are located at the outermost sides of the cavity are static and the remaining wedge members are alternately static and moving.

In accordance with another aspect of the present invention, after the solid pharmaceutical products have been arranged in one or more of the linear transmission systems 16 or vertical stacks, the solid pharmaceutical products 12 are selectively transmitted into individual product package blister cavities or into product package templates having locations corresponding to the blister package cavities via escapement mechanisms 22. A variety of different unique escapement mechanisms are also described in more detail below.

Figure 2:
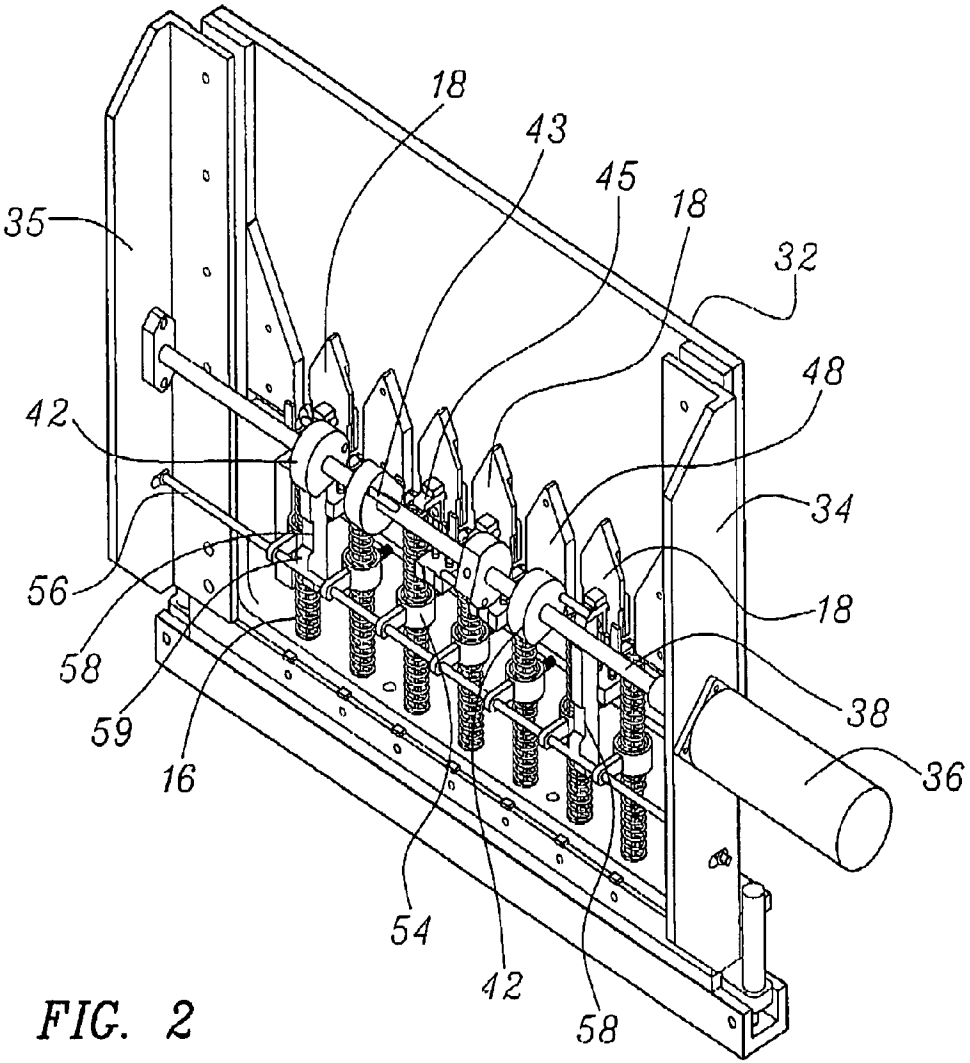
FIG. 2 illustrates a first preferred exemplary embodiment of the mechanical drive system for translating a two-dimensional random arrangement of solid pharmaceuticals or other products into a one-dimensional array or stack.

As noted above, the random two-dimensional orientation of the solid products 12 is advantageously provided in a temporary storage compartment that is preferably comprised of two substantially planar panels defining a cavity therebetween. FIG. 2 illustrates in more detail a preferred mechanical drive system for displacing the wedge shaped members 18 and the overall system arrangement. As shown in FIG. 2, of the cavity defining panels 32 for containing the solid pharmaceutical products is secured adjacent to the wedge-shaped members 18. For the sake of illustration, the remaining panel for defining the cavity is not shown. During operation, the remaining panel is placed on the other side of the wedge-shaped members 18 so that the cavity is formed between the additional panel and the panel 32.

It is preferred that at least one or both of the planar members 32 are comprised of a clear plastic material so that an individual operating the packaging machinery can readily visually examine the processing and transmission of a plurality of solid pharmaceutical products. Those skilled in the art will appreciate that the planar arrangement of the panels is preferred in order to provide an initial two-dimensional orientation of the product so that the pills or other solid products can be readily oriented in a linear fashion for transmission through the linear transmission channels 16.

In the embodiment illustrated in FIG. 2 vertical support members 34 and 35 provide a frame to which the planar members 32 are secured. An electric motor 36 is provided for agitating the wedge-shaped members 18. In accordance with the preferred embodiment, the electric motor 36 is conveniently secured to one of the vertical support members 34. The electric motor 36 rotates a drive shaft 38 that is secure between the vertical support members 34 and 35. The drive shaft 38 also rotates a plurality of cam members 42 which are used to provide the initial downward motion of the wedge-shaped members 18 against springs which are described below. Once the wedge shaped members 18 are released, the springs advantageously quickly displace the wedge-shaped members 18 upward into the random two-dimensional array of solid pharmaceutical products contained between panel members 32.

The inventors of the instant application have discovered that greater operating efficiencies and speed can be achieved by initially providing a two-dimensional arrangement of the solid pharmaceutical products prior to transitioning into a one-dimensional arrangement for convenient dispensation of the solid pharmaceutical products into a blister package cavity. As noted in more detail below, other arrangements are also possible.

In accordance with the preferred exemplary embodiment two-dimensional funnels are formed within the cavity defined by the two planar panels 32. The funnels are preferably defined by adjacent wedge shaped members 18 having a thickness which is slightly smaller than the width of the cavity holding the solid pharmaceutical products in a two-dimensional array between the panels 32. In accordance with the preferred exemplary embodiment, an automated shaking mechanism displaces one or more of the wedge shaped members 18 downward and upward in the cavity holding the two-dimensional array of solid pharmaceutical products. In accordance with the preferred exemplary embodiment, the wedge-shaped members 18 are mounted on one or more mechanical guides and are in contact with springs that bias the wedge-shaped members into an uppermost position of their range of motion. The precise arrangement of the mechanical guides and the springs which drive the wedge-shaped members are described in more detail below.

The drive motor 36 rotates the drive shaft 38 having cam members 42 with mechanical contacts 43 that physically displace each of the wedge-shaped members downward against mechanical force of the spring or spring associated with each wedge-shaped member. As illustrated in FIG. 2, the mechanical contact 43 is essentially a protruding pin member that periodically contacts a mechanical catch 45 when the drive shaft 38 is rotating. The catch 45 is secured to any wedge shaped member 18 that is to be agitated. The electric motor 36 rotates the drive shaft 38 having the cam members 42 with returning pins 43 that periodically contact the mechanical catch 45 to thereby push each wedge-shaped member 18 downward against the force of one or more springs.

Once the mechanical contact 43 of the cam member 42 is no longer in contact with a mechanical catch 45 associated with the wedge member 18, one or more springs associated with the wedge member quickly forces the wedge member upwardly into the cavity containing the two-dimensional array of solid pharmaceutical products. The initial downward and subsequent rapid upward motion of the wedge member rapidly pushes solid pharmaceutical that are located above the wedge member 18 upward and away from the linear transmission channel 16 located at the bottom of the funnel defined by two adjacent wedge members 18. This downward and quick upward physical displacement and the shape of the two-dimensional funnel defined by the adjacent wedge shaped members 18 quickly and conveniently aligns the solid pharmaceutical products so that they readily fall into the linear transmission channels 16 that are located at the bottom of each funnel. Any blockage of the funnel occasioned by the random orientation of the solid pharmaceutical products is quickly eliminated and the linear transmission channels are rapidly filled with the solid pharmaceutical products.

In accordance with the presently preferred exemplary embodiment, the two-dimensional cavity defined by the panel members 32 preferably includes a plurality of wedge members 18 generally arranged at a common horizontal position between the panels. The arrangement of the adjacent wedge-shaped members 18 defines a plurality of two-dimensional funnels. Each of the two-dimensional funnels is located within the cavity. The funnels defined by the adjacent wedge shaped members directly feed into a corresponding linear transmission channel 16 for the solid pharmaceutical products.

The linear transmission channels provide a one-dimensional arrangement of the solid pharmaceutical products for convenient selective dispensing of the product from the linear transmission channels into a product package cavity. In accordance with the preferred exemplary embodiment, it is preferred that a single drive motor 36 and drive shaft 38 located adjacent to the two-dimensional solid pharmaceutical product package cavity includes a plurality of cam members 42 each with a pin 43 and a corresponding mechanical contact 45 that drives a corresponding wedge shaped member 18. In the preferred exemplary embodiment, one static wedge-shaped member is located adjacent to one of the wedge-shaped members that is physically displaced downward and upward into the cavity having a two-dimensional array of solid pharmaceutical products.

For example, as illustrated in FIG. 2, the wedge-shaped member 48 does not have a mechanical catch 45 secured to its side. The wedge-shaped member 48 is therefore static and there is no need to provide a corresponding cam member and mechanical contact for this wedge-shaped member. Those skilled in the art will appreciate that it is also possible to have each of the wedge shaped members move as described above. In the preferred exemplary embodiment, every other wedge-shaped member 18 is a static wedge-shaped member such as the wedge-shaped member 48. Because it is preferred to have the to outermost funnel portions static, when there is a odd number of channels, it is necessary to have two moving wedges 18 adjacent to each other. The wedge-shaped members 18 located between any static wedge-shaped member such as the wedge-shaped member 48 each have a corresponding mechanical catch 45 and associated cam member 42 with corresponding mechanical contact 43.

Although a variety of different arrangements are possible, it is preferred that the mechanical displacement of each of the wedge-shaped members 18 for a single two-dimensional array of solid pharmaceutical products is arranged to be slightly out of phase from one another so that the instantaneous load on the drive motor 36 is reduced. More specifically, in the preferred exemplary embodiment, a plurality of static and moving wedge-shaped members are provided across the bottom of the two-dimensional cavity containing the random arrangement of solid pharmaceutical products. In utilizing such approach, every static wedge-shaped member may be separated by intervening wedge shaped members 18 which are physically displaced in the cavity. The desired out of phase displacement of the dynamic wedge-shaped members 18 is readily achieved by having each of the mechanical catch members 45 located at a common horizontal level. The phase relationship therefore is conveniently achieved by simply locating the mechanical contact members 43 for each of the cam members 42 different locations around the circumference of the drive shaft 38. Any desired sequential displacement of the dynamic wedge-shaped members 18 is therefore readily achieved by simply adjusting the corresponding location around the drive shaft 38.

Those skilled in the art will appreciate that a variety of different mechanical drives and arrangements are possible for making and using the present invention and that the specific arrangement described in the instant application is only the preferred approach and currently contemplated best mode of making and using the present invention. For example, it is contemplated that a variety of different drive mechanisms may be used to displace the wedge shaped members. Specifically, although a spring biased mechanical motion is described which relies upon an electric drive motor having cam members which temporarily displace the wedge-shaped members against the mechanical spring bias, it is contemplated that pneumatic drives or other electric solenoid type drives or alternate motor drive arrangements may also be utilized for the purpose of downwardly and upwardly displacing the wedge shaped members in accordance with the present invention. Furthermore, although it is preferred to rely upon the release of spring energy for vertically displacing the wedge-shaped members, it should be recognized that other the particular mechanism through which the displacement of one or more wedge-shaped members is achieved is not important and that virtually any known mechanical drive will work to achieve the desired orientation.

Figure 3:
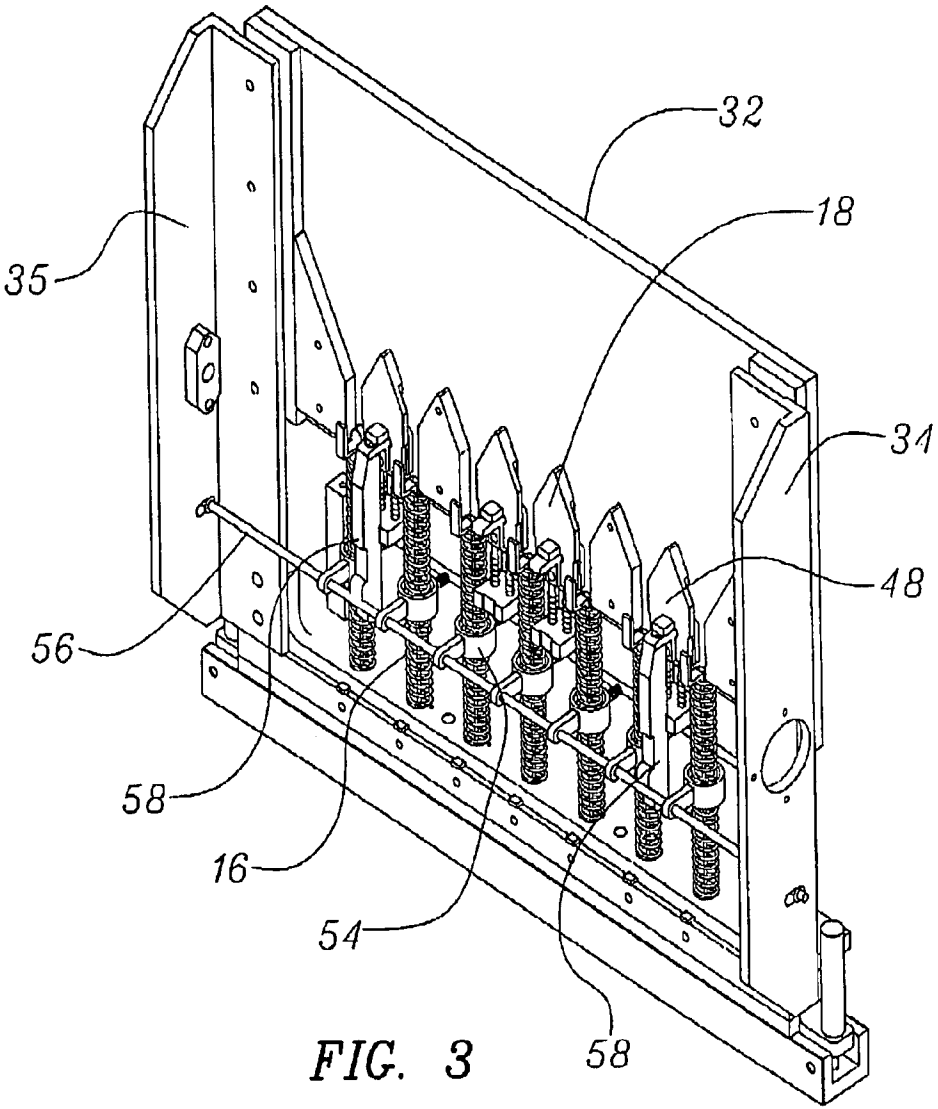
FIG. 3 illustrates alternate details of the first preferred exemplary embodiment of the mechanical drive system for translating a two-dimensional random arrangement of solid pharmaceuticals or other products into a one-dimensional array or stack.

FIG. 3 illustrates the embodiment of FIG. 2 wherein the electric motor 36 and drive shaft 38 have been eliminated for the purpose of demonstrating the details of the structure behind the drive shaft and the cam members 42.

As noted above, the preferred two-dimensional funnel members that are defined by the panels 32 and the wedge-shaped members 18 feed into linear transmission channels 16 that are provided in correspondence with each funnel. The linear transmission channels 16 are preferably arranged vertically beneath a corresponding funnel and may be comprised of a channel that is defined by a plastic or metal tube. When the linear transmission channels are constructed as a tube, the tube may be either cylindrical or rectangular and preferably includes wings or spacers which position the individual solid pharmaceuticals in a stack separated from the internal side walls of the tube member. Alternatively, the linear transmission channel may be defined by a plurality of metal or plastic rods which define the channel for stacking a plurality of solid pharmaceutical, nutraceutical or other products.

Figure 4:
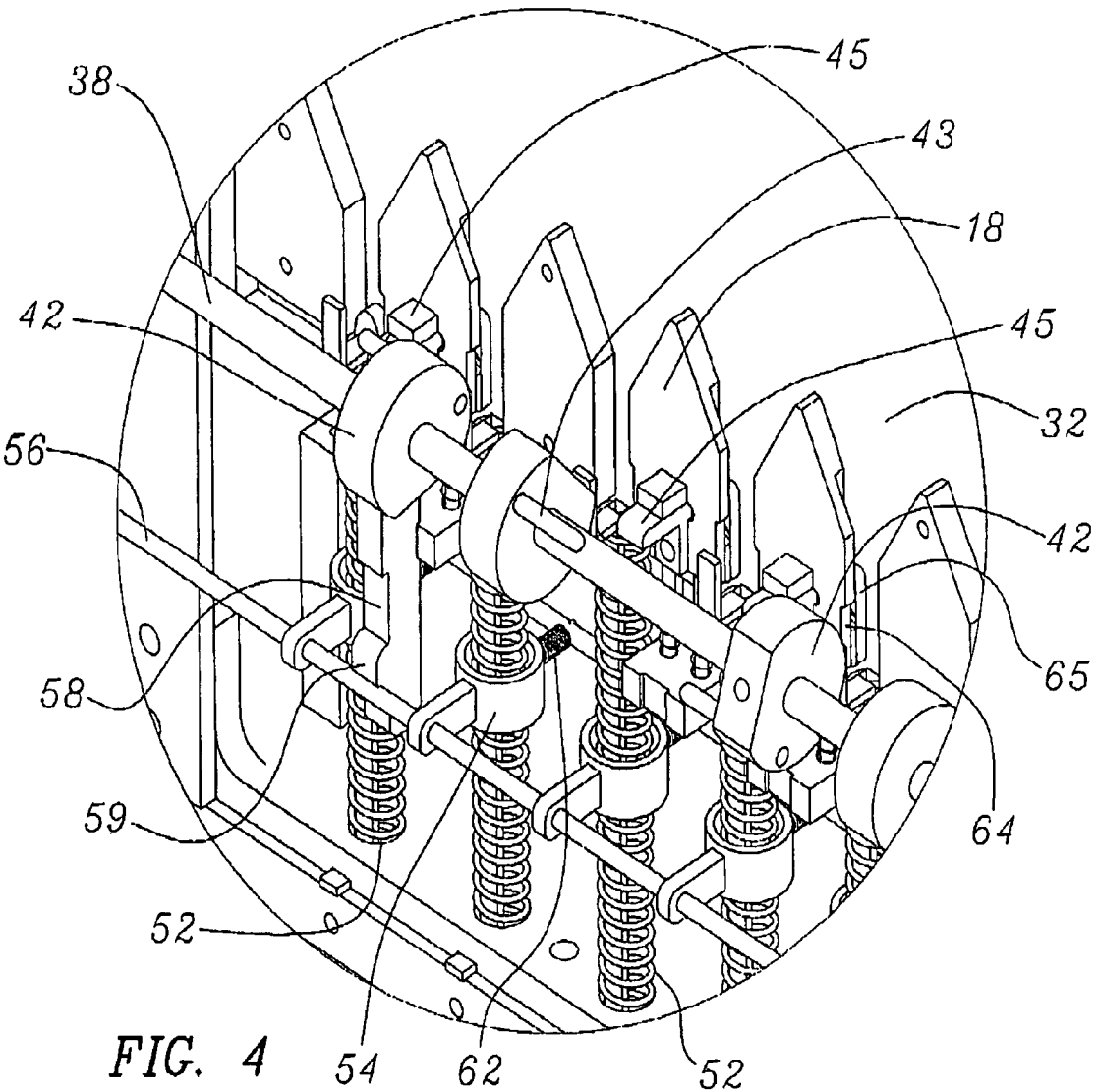
FIG. 4 illustrates details of the mechanical drive and linear transmission system for the system shown in FIGS. 1 and 2.

In accordance with a further alternate preferred embodiment, each of the linear transmission channels may be defined by a metallic spring within which a plurality of the solid pharmaceutical products are stacked. FIG. 4 illustrates the details of the agitation mechanism for the embodiment illustrated in FIGS. 2 and 3. As shown in FIG. 4 each of the linear transmission channels 16 is illustrated as a spring 52. The inventors have discovered that the use of a spring for defining the linear channel 16 is particularly suitable for preventing gel caps from sticking to the sidewalls of the linear transmission channels. The use of a metallic spring such as the spring 52 is preferred because springs can be easily mechanically vibrated when the individual solid pharmaceuticals, nutraceuticals or other products are being transferred through the linear transmission channel defined as spring 52 in order to prevent the solid pharmaceutical products from getting stuck within the linear transmission channels.

In order to cause the vibration of the springs 52, the springs 52 have a preferably centrally located spring striker 54 that are each secured to a common spring shaker rod 56 that is preferably movably secured within the frame members 34 and 35. At least one spring shaker drive member 58 is moved up and down as a result of the rotation of the drive shaft 38. In the illustration of FIG. 4, the spring shaker drive member 58 includes a protruding portion 59 that is used to laterally displace the spring shaker rod 56. In the preferred embodiment, each spring shaker drive member 58 is secured to one of the dynamic wedge-shaped members 18. Accordingly, the spring shaker drive 58 moves up-and-down with its corresponding dynamic wedge-shaped member 18 when the corresponding pin 43 of the associated cam 42 strikes the catch 45.

This up-and-down motion is translated by the protrusion 59 into the horizontal displacement of the spring shaker rod 56 due to the above-described mechanical interconnection. The horizontal motion of the spring shaker rod 56 as a result of the downward motion of the protruding portion 59 moves each spring striker 54 away from the spring 52. Each spring striker 54 preferably has an inner diameter that is greater than the spring 52 located within the spring striker 54. In order to quickly move the spring striker 54 against its corresponding spring 52, at least one additional spring striker return spring 62 is provided on an opposite side of each spring striker 54.

The additional spring striker return springs 62 simply pull each spring striker back in a direction opposite from the direction of motion caused by the protruding member 59 so that when the spring striker 54 is moved away from its initial position, it quickly returns toward the spring 52. In accordance with the preferred exemplary embodiment, the protrusion 59 is designed to be of a shape such that immediately after reaching a greatest distance from the spring striker return spring 62, the spring striker 54 moves quickly back toward the spring 52, so that it strikes the spring and causes a high-frequency vibration of the spring 52. The high high-frequency vibration of the spring 52 desirably eliminates any blockage of the linear transmission channel 16 defined by the spring 52.

Another aspect of the design illustrated in FIG. 4 is a notched portion 64 of the wedge member 18. The notched portion 64 of the wedge member 18 is positioned and formed such that when a wedge 18 is at its lowermost position, the outermost portions of two adjacent wedges defines a beginning of the linear transmission channel. The notched portion 64 is adjacent an uppermost side of the spring 52 and the outermost portion of each wedge member above the notch extends to be at or around the inside diameter of the spring 52.

Additionally, a wedge spacer 65 is provided and secured to the panel 32. The wedge spacer 65 ensures that the appropriate transmission channel dimensions extend adjacent to the wedge members 18 regardless of the vertical position of the wedge.

Figure 5:
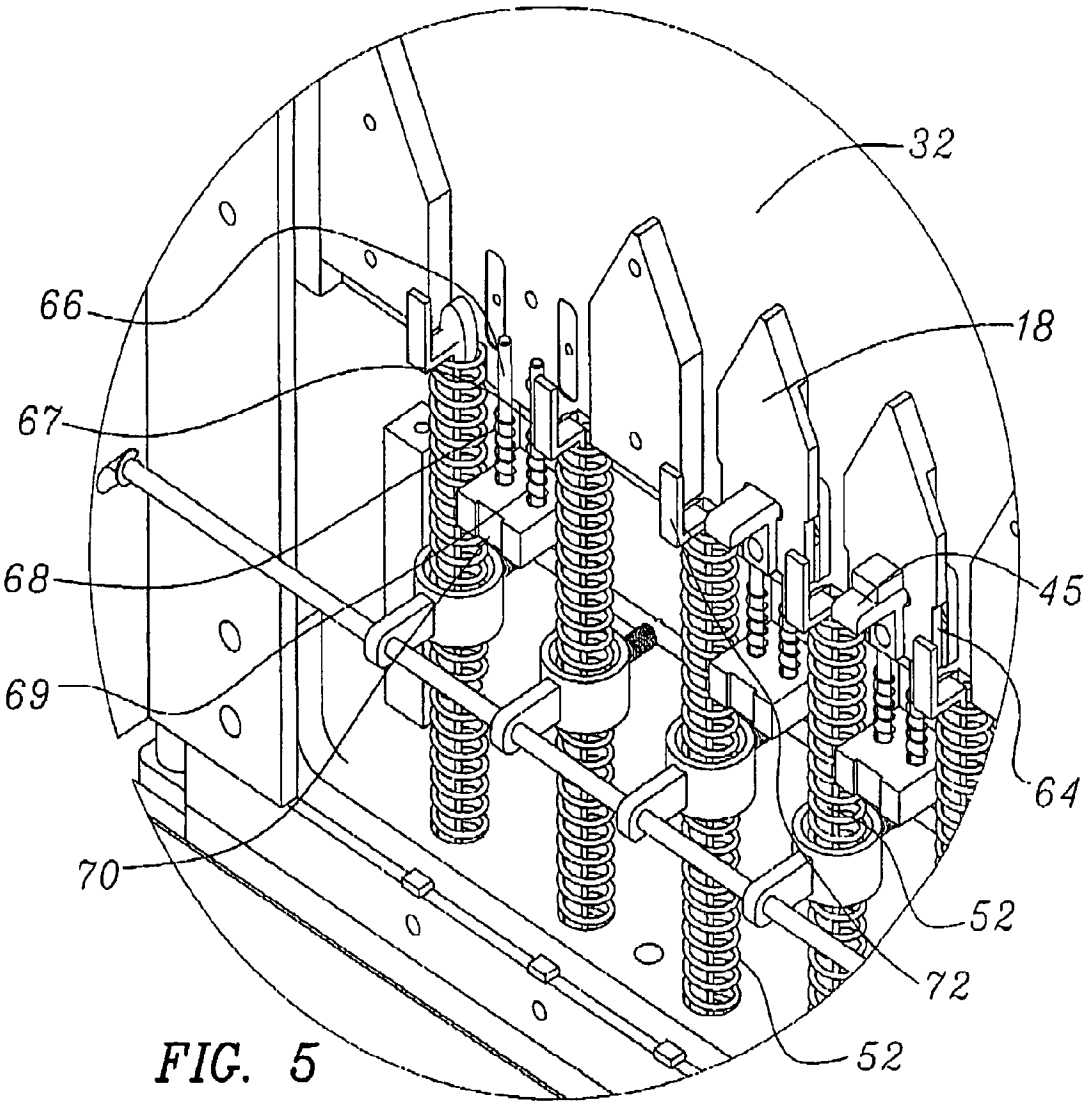
FIG. 5 illustrates additional details of the mechanical drive and linear transmission system for the system shown in FIGS. 1 and 2.

FIG. 5 illustrates in greater detail the aspects of the overall system directed to vibrating the linear transmission channels defined by springs 52 and displacing wedge shaped members 18. As shown in FIG. 5, the movable wedge-shaped members 18 are movably secured via left and right pin guides 66, 67. Each of the dynamic wedge-shaped members 18 is preferably mounted upon at least two of these guides. The left and right pin guides 66, 67 are located within wedge-driving springs 68, 69 that rest upon base 70. The wedge driving springs 68, 69 are used to bias the wedge-shaped members 18 in an uppermost position of their range of motion. As noted above, the mechanical catch 45 is driven by a mechanical contact that is not shown in this illustration. Initially, the wedge-shaped members 18 are driven downward against the force of the wedge-driving springs 68, 69. When the mechanical catch 45 is no longer in contact with the mechanical contact 43 of a corresponding cam member 42 on the drive shaft 38, the wedge driving springs 68, 69 immediately force the wedge-shaped member upward thereby dislodging any blockage of the funnel or linear transmission channel.

FIG. 5 illustrates yet another alternate aspect of the present invention which is directed to the use of a channel insert 72 that conveniently alters the interior of the linear transmission channel defined by the spring 52. More specifically, this flat metal or plastic channel insert 72 is used only when the medication or solid product is not round in cross-section and/or there is no circular symmetry for the product. Advantageously, the use of the channel insert 72 alters the interior dimensions of the channel so that pills which are not circular in cross-section can more easily transit through the channel without blocking the linear transmission channel. FIG. 5 also illustrates the wedge spacer 65 attachment points 73 that are provided for securing the wedge spacer 65 to the panel 32.

Figures 6A, 6B:
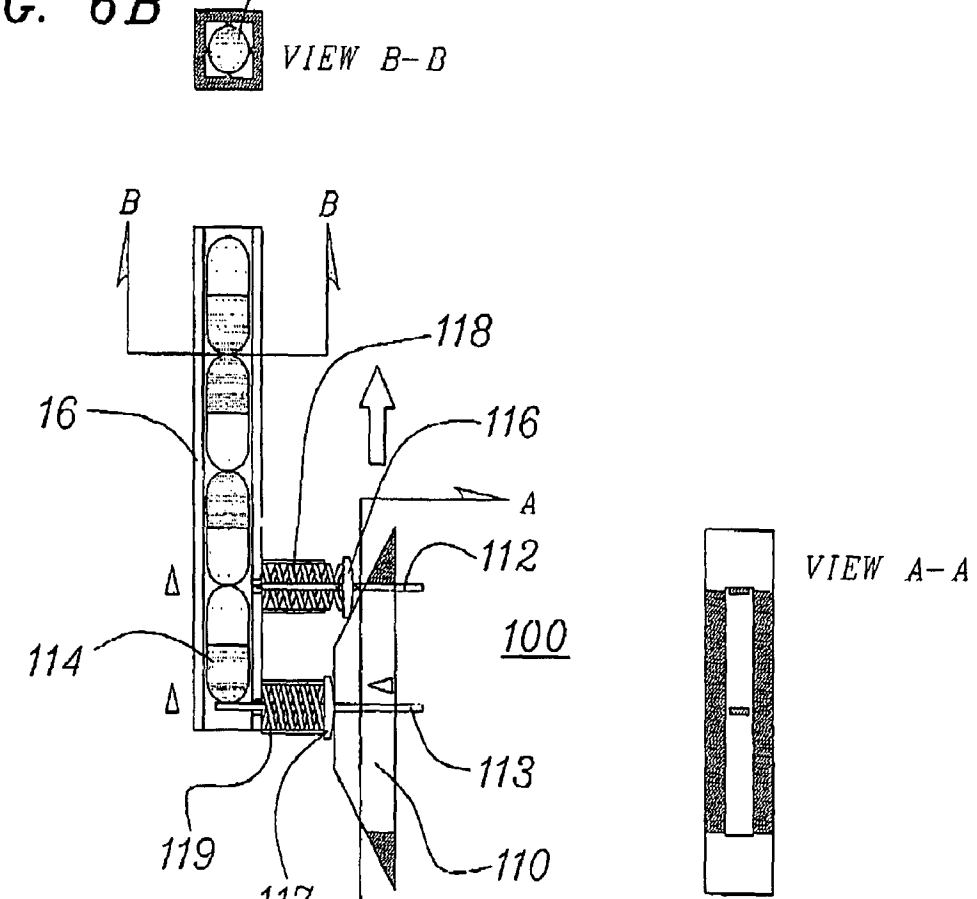
FIG. 6 A illustrates a first preferred embodiment of the linear transmission system and escapement mechanism.

In accordance with another aspect of the present invention, a plurality of alternate unique mechanical escapement mechanisms are provided to assure the rapid and convenient selective transmission of a single solid pharmaceutical product from the linear transmission channels as desired. For example, FIG. 6A illustrates a first alternate exemplary embodiment of the escapement mechanism which is shown generally at 100. A vertical drive member 110 selectively toggles upper 112 and lower 113 solid pharmaceutical product catcher mechanisms which ensure that only one solid pharmaceutical product is delivered as desired from the linear transmission channel 16. During operation of the device, initially the lowermost catcher mechanism 113 prevents the lowest solid pharmaceutical product 114 from escaping the linear transmission channel 16.

The toggling action of this device is achieved as a result of the convenient vertical displacement of the vertical drive member 110. The vertical drive member 110 is shaped to alternately mechanically displace the upper 112 and lower 113 solid pharmaceutical product catch mechanisms based on the up-and-down motion of the vertical drive member 110. The upper 112 and lower 113 solid pharmaceutical product catcher mechanisms each respectfully include corresponding drive contacts 116, 117 that mechanically interact with the vertical drive member 110 having outwardly angled upper and lower portions which enable the vertical displacement of the vertical drive member 110 and the sliding action across the upper and lower drive contacts 116, 117 to conveniently enable the toggling of the upper and lower product catch mechanisms 112, 113.

When the vertical drive member 110 is in an uppermost position, the central portion of the vertical drive member 110 is in contact with the upper drive contact 116 and the outwardly angled lower portion of the vertical drive member 110 is in contact with the lower drive contact 117. In this orientation, the lower solid pharmaceutical catcher mechanism is moved away from the solid products and allows them to pass while the upper solid pharmaceutical catcher mechanism 113 blocks any additional products from passing.

Upper 118 and lower 119 catcher displacement spring ensures that the upper 112 and lower 113 solid pharmaceutical product catcher mechanisms are biased against the vertical drive member 110. As a result, the simple sliding action of the vertical drive member is able to toggle the upper 112 and lower 113 solid pharmaceutical product catcher mechanisms. The vertical drive member 110 thereafter moves downward and this downward motion of the vertical drive member positions the lower catch mechanism 113 back into the channel 16 and the upper catch 112 is moved away from the channel 16. This is achieved because the upper portion of the vertical drive member which is angled outward is in contact with the upper catch mechanism 112. This alternate arrangement thereby enables all solid pharmaceutical products within the channel to drop by one position such that the remaining lowermost solid pharmaceutical product moves into contact with the lowermost catch mechanism 113.

The toggling action of the device thereby enables the selective dropping of the solid pharmaceutical product or vitamin from the linear transmission channel 16 into a solid pharmaceutical product package cavity or temporary storage mechanism that is located beneath the linear transmission channel. FIG. 6B is a cross-sectional view of the linear transmission channel 16. As shown in FIG. 6B, spacer wings are formed within the channel to move the solid pharmaceutical product 12 away from the sidewalls of the linear transmission channel.

Figure 7A:
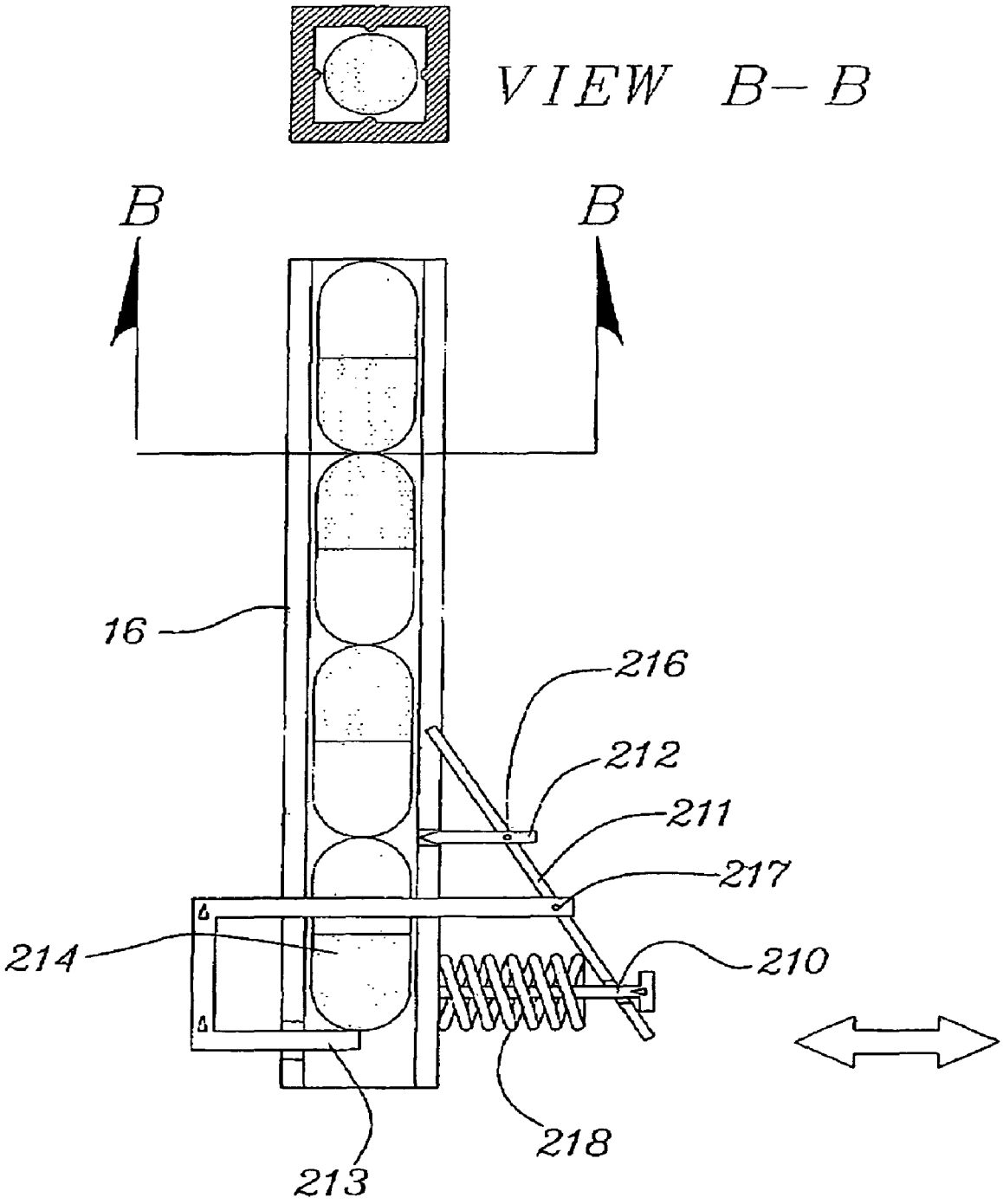
FIG. 7 A illustrates a first preferred embodiment of the linear transmission system and escapement mechanism.

FIG. 7 illustrates a first alternate exemplary embodiment of the escapement mechanism which is shown generally at 200. A horizontal support member 210 provides support for the operation of the structures described hereafter. The toggling of upper 212 and lower 213 solid pharmaceutical product catcher mechanisms ensure that only one solid pharmaceutical product is delivered as desired from the linear transmission channel 16. During operation of the device, initially the lowermost catcher mechanism 213 prevents the lowest solid pharmaceutical product 214 from escaping the linear transmission channel 16.

The toggling action of this device is achieved as a result of the convenient horizontal movement against the lever 211. The lever 211 alternately mechanically displaces the upper 212 and lower 213 solid pharmaceutical product catch mechanisms based on the lateral motion of the lever 211. The upper 212 and lower 213 solid pharmaceutical product catcher mechanisms each respectfully include corresponding drive contacts 216, 217 that mechanically interact with the lever member 211 to conveniently enable the toggling of the upper and lower product catch mechanisms 212, 213 based on the convenient horizontal displacement of the lever 211.

When the lever 211 is at its leftmost position, the lever member 211 pushes the upper solid pharmaceutical product catcher mechanism 212 into the linear transmission channel 16 also pushing of the lower catcher mechanism 213 away from the channel. In this orientation, the lower solid pharmaceutical catcher mechanism 213 is moved away from the solid products and allows them to pass while the upper solid pharmaceutical catcher mechanism 212 blocks any additional products from passing.

A single horizontal drive displacement spring 218 pushes outward against the lever 211. As a result, the simple sliding action of the horizontal drive member is able to toggle the upper 212 and lower 213 solid pharmaceutical product catcher mechanisms. The lever 211 moves outward and this outward motion of the lever 211 positions the lower catch mechanism 213 back into the channel 16 and the upper catch 212 is moved away from the channel 16. This alternate arrangement thereby enables all solid pharmaceutical products within the channel to drop by one position such that the remaining lowermost solid pharmaceutical product moves into contact with the lowermost catch mechanism 213.

The toggling action of the device thereby enables the selective dropping of the solid pharmaceutical product or vitamin from the linear transmission channel 16 into a solid pharmaceutical product package cavity or temporary storage mechanism that is located beneath the linear transmission channel.

Triggering of the toggling action for the escapement mechanism may be achieved in a variety of different manners such as, for example, via the use of an electronic solenoid, an electric motor drive, or a pneumatic drive. Those skilled in the art will appreciate that the specific mechanical actuator is not critical to the operation of the device.

Figures 8A, 8B:
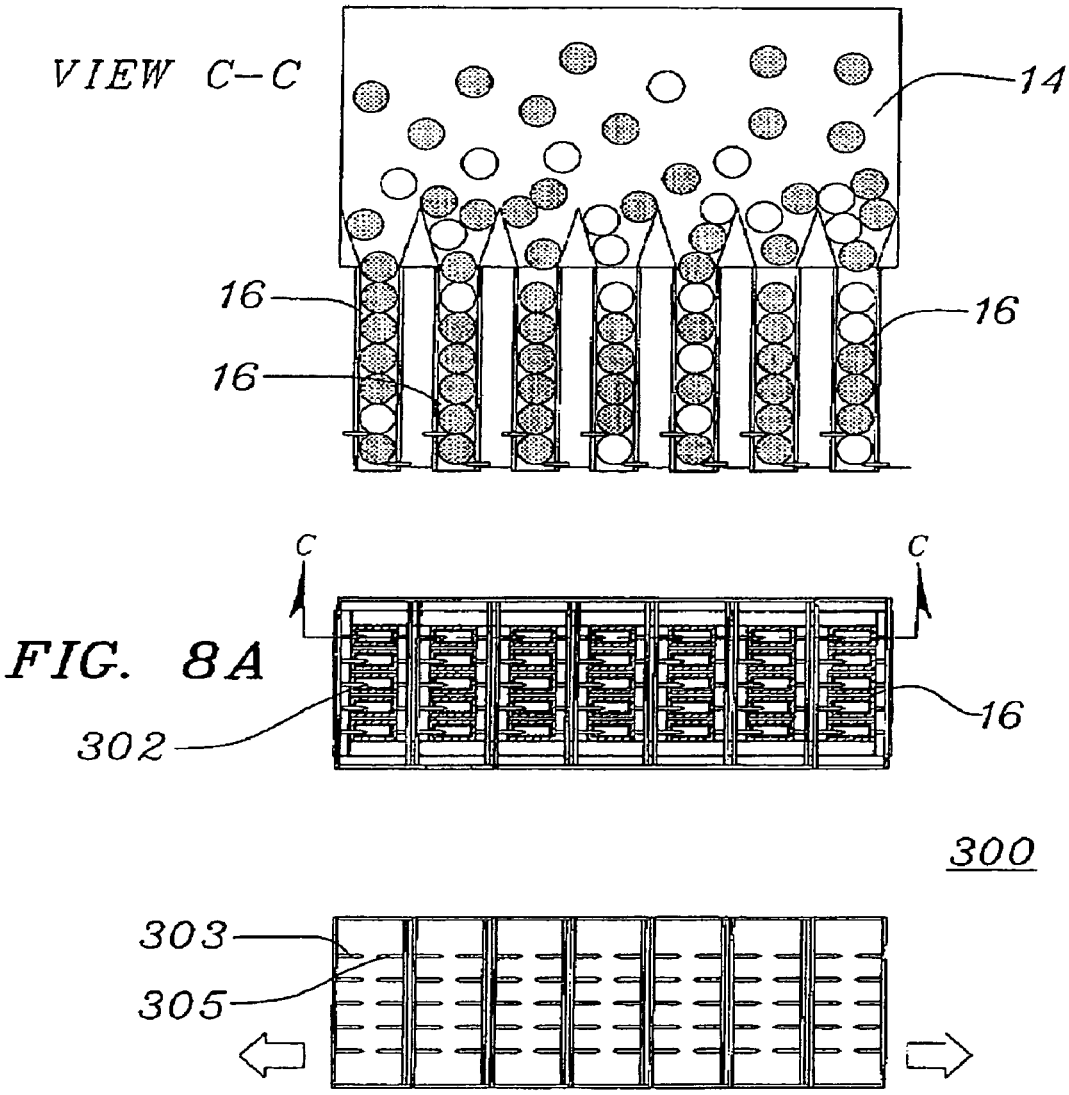
FIG. 8 illustrates an array of dispensing mechanisms and a frame of actuating members.

FIG. 8A illustrates a preferred exemplary embodiment of the present invention wherein the funnels and linear transmission channels having corresponding escapement mechanisms are preferably provided in two-dimensional array that is shown generally at 300. It is particularly preferred that the exit locations for the solid pharmaceutical products correspond with desired locations of a corresponding blister package cavity or temporary storage mechanism associated with locations corresponding to a blister package cavity. The inventors have discovered that dramatic increases in packaging efficiency and speed can be achieved by utilizing one or more arrays of the described dispensing mechanisms for filling solid pharmaceutical product packaging.

In one alternate embodiment, a one-dimensional linear array having funnels and linear transmission channels corresponding to each member of a complete row of blister package cavities in a solid pharmaceutical product package can be utilized to simultaneously fill each cavity or the location of a product package template corresponding to each cavity in the row. More specifically, in such embodiment, the escapement mechanism for each linear transmission channel can be triggered at the same time to simultaneously fill each row.

FIG. 8 A illustrates a top plan view of a plurality of linear transmission channels that are positioned within a frame of actuating members. The actuating members may push against the actuating members for the escapement mechanisms provided above. This frame advantageously enables a large number of linear transmission channels to be activated simultaneously. Alternatively, the frame members can be designed to include each of an upper and lower catch mechanism for a plurality of linear transmission channels arranged in an array. In such an alternate embodiment, movement of the frame itself automatically toggles the catch and release of pharmaceutical products in the linear transmission channels that are located within the array. FIG. 8 B illustrates a plurality of upper catchers 303 and lower shutters 305 for simultaneously releasing an individual solid product from a plurality of linear transmission channels.

Figure 9B:
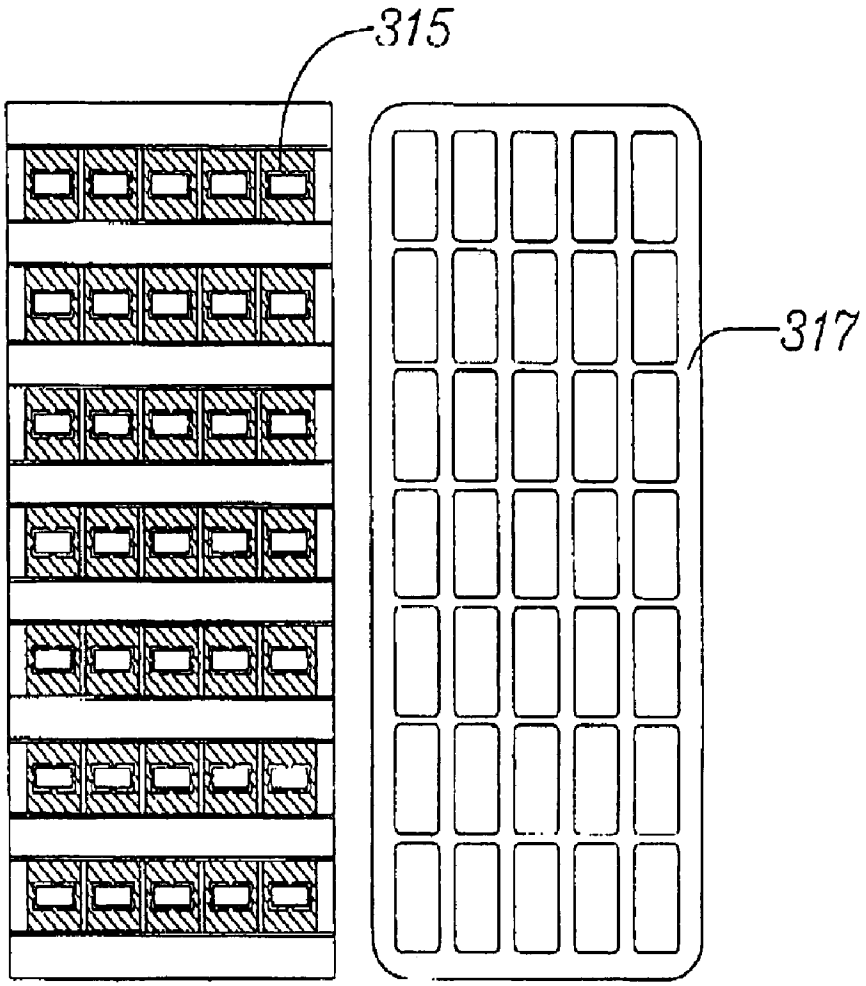
FIG. 9 illustrates the system for simultaneously dispensing individual solid products.
Figure 9A:
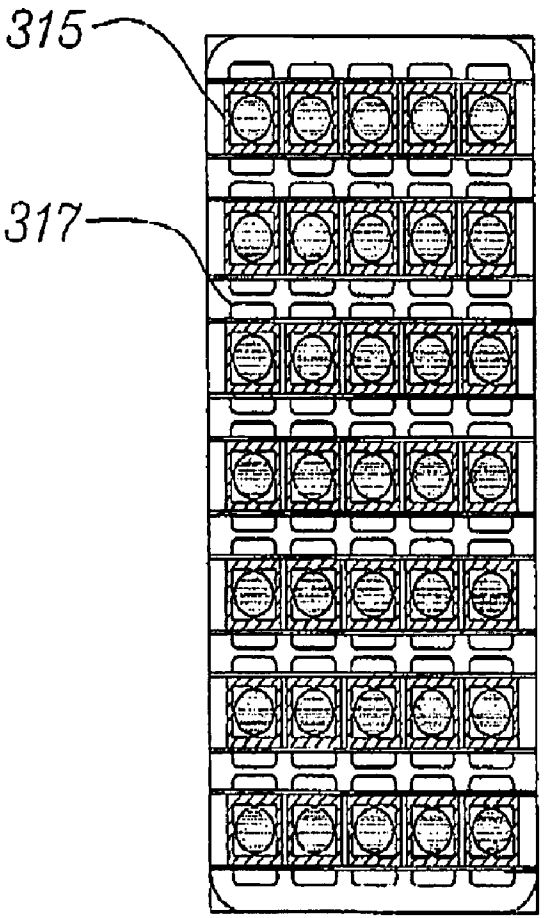

FIG. 9A illustrates yet another alternate embodiment wherein a matrix of funnels and linear transmission channels corresponding to a plurality of rows of blister package cavities or corresponding to all rows of cavities in a blister package or product package template is provided. In such an alternate embodiment, the same medications may be provided in the array in order to simultaneously fill all cavities with the same medications. Alternatively different medications may be provided in each row of the array in order to selectively locate different medications from positions in the array into desired product package cavities or the locations of a package template corresponding to the blister package cavities. In FIG. 9 A, a plurality of rows of linear transmission channels 315 are located directly above the plurality of blister package cavities for pharmaceutical product package. FIG. 9 B illustrates a plurality of rows of linear transmission channels 315 located adjacent to a blister package sheet 317.

Figure 10:
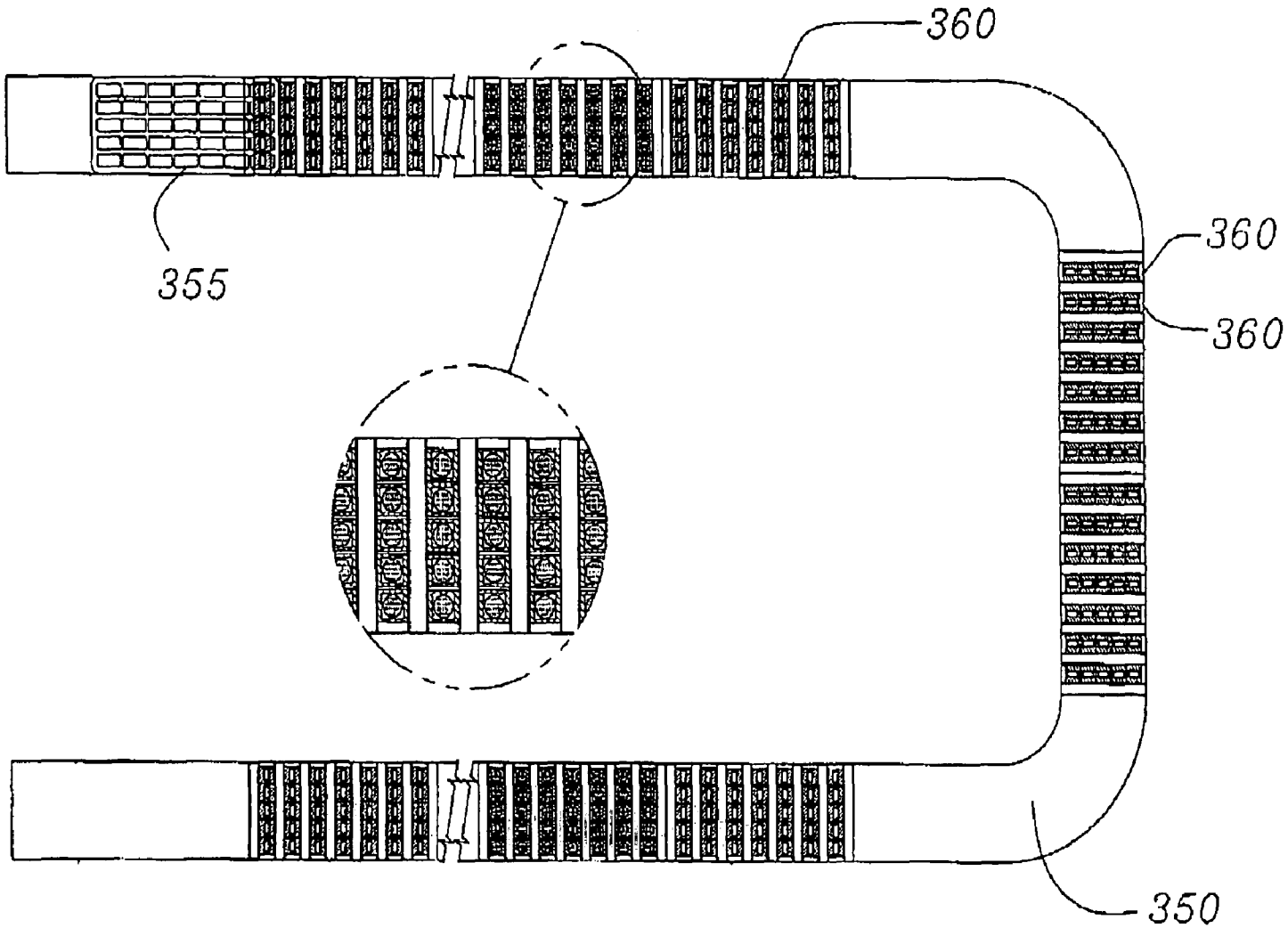
FIG. 10 illustrates the system for positioning product package cavities or package templates underneath a plurality of different dispensing mechanisms via a conveyor system.

FIG. 10 illustrates yet another alternate aspect of the present invention wherein a conveyor 350 is provided for the purpose of moving blister package cavities or package templates beneath one or more arrays of the above-described dispensing mechanisms in order to provide greater flexibility in the different types of medications that may be inserted into the blister package cavities for patient use. For example, by providing a single row that is filled with a common type of medication, the only limitation placed upon the number of different medications that can be inserted into the blister package cavities is the number of different types of medications contained in rows of the dispensing mechanisms. Specifically, as many as 400 or more rows of dispensing mechanisms may be provided in arrangement such that the conveyor positions the blister package cavities or a package template corresponding to the locations of the blister package cavities beneath each desired row. Such an arrangement would provide a system that is capable of filling virtually any type of medication that is typically desired or used in a normal hospital or managed care facility.

Figure 11:
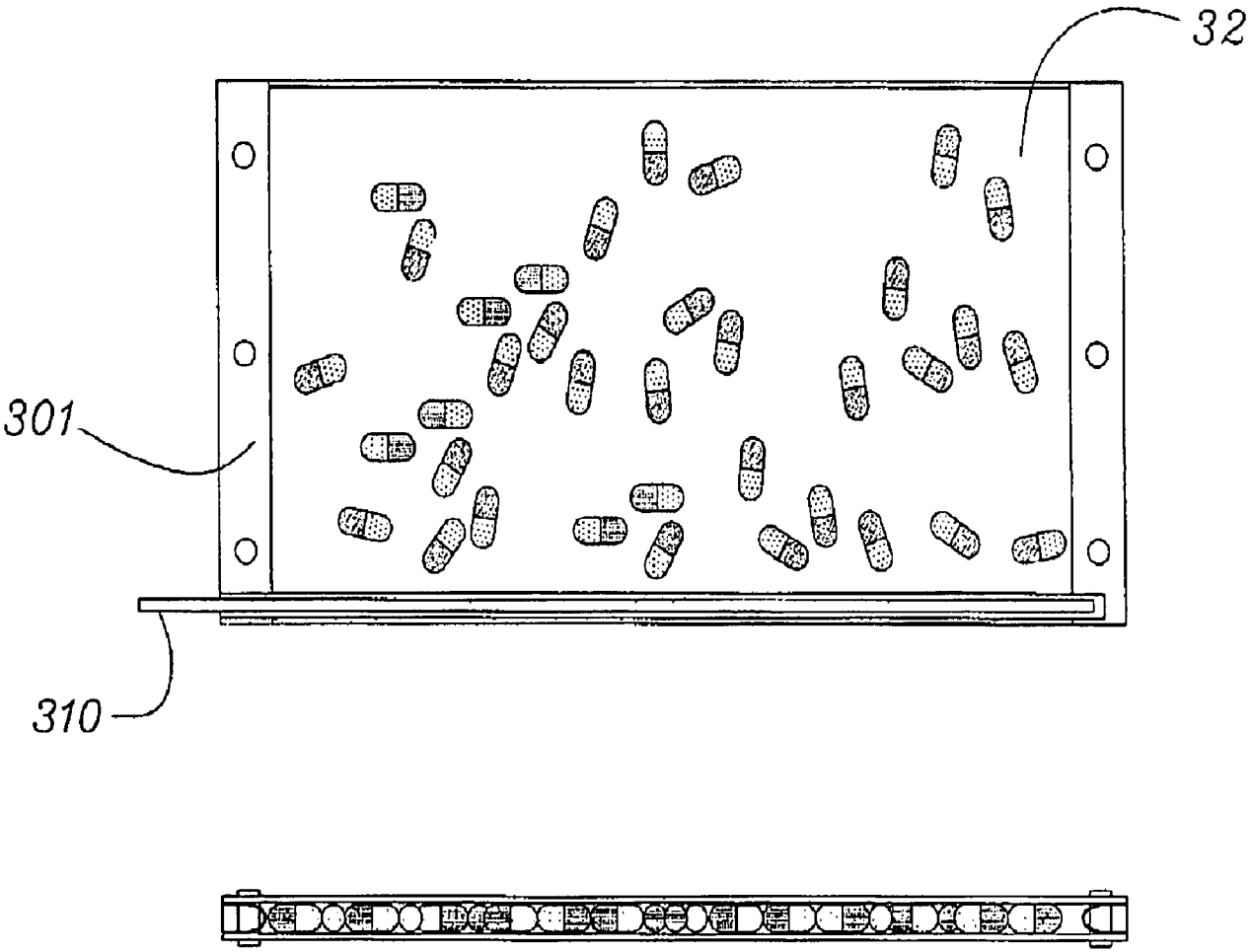
FIG. 11 illustrates a prefilled magazine for use in conjunction with a present invention.

FIG. 11 illustrates yet another alternate aspect of the present invention that is directed to the use of a pre-filled magazine 301 containing a two-dimensional random array of the solid pharmaceutical products. Advantageously, the pre-filled magazine 301 may be conveniently placed directly over the cavity within which the wedge shaped members are positioned. A sliding door 310 is located at the bottom of the pre-filled magazine 301. The sliding door 310 is preferably manually opened in order to allow the medications to freely move into position above the wedge shaped members so that the solid pharmaceutical products may rearranged from a two-dimensional random array into a one-dimensional linear stack for placement into individual package cavities as described above. The pre-filled magazines may be manually filled or an automated system may be provided for filling the magazines. For the purpose of filling the magazine, 301, a hinge is provided to conveniently open the internal cavity of the magazine 301 for manual filling of the magazine. For automatic filling, it is preferred that one of the panel members be secured via pin members for convenient access to the cavity.

Figure 12A:
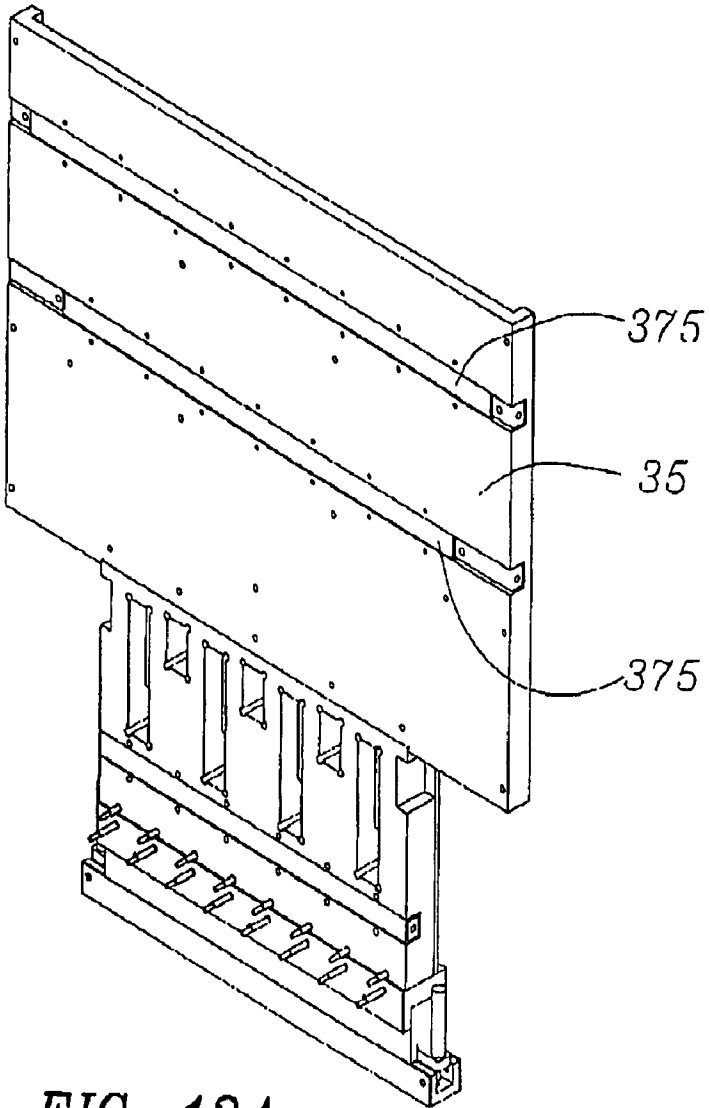
FIG. 12 A illustrates a recess formed in a panel for defining the two-dimensional cavity having the random orientation of solid pharmaceutical products which receives a batch door mechanism.
Figure 12B:
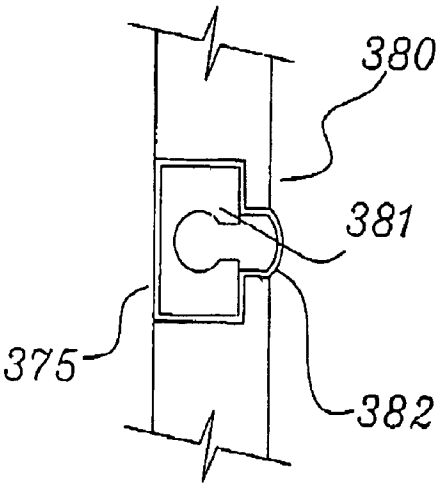

Yet another aspect of the present invention is the use of batch doors preferably located in the two-dimensional cavity formed above the wedge shaped members 18. FIG. 12 A illustrates an exemplary embodiment of a batch door cavity 375 formed within a panel 35 for use in conjunction with the present invention which is generally shown at 330. The inventors of the instant application have discovered that the random two-dimensional arrangement of pharmaceutical products is more readily achieved if there is some free-space provided above the wedge-shaped members 18. The space provided above the wedge-shaped members 18 enables the upward displacement of the wedge-shaped members to more easily move upward away from the wedge members. This motion allows for re-orientation of the solid products so that the funnels can direct the products into the linear transmission channels. The batch doors also limit the downward force that is caused by the cumulative effect of the solid products. The inventors have discovered that when a large number of the solid pharmaceutical products are provided above the wedge-shaped members, the greater downward force on the lowest product members increases the potential for jamming of the funnels. The batch doors limit the downward force on the lowest individual products.

As shown in FIG. 12 B, a batch door is comprised of a protruding member that is located in a linear cavity 375 that is formed in the side of one of the planar side walls 35 which forms the two-dimensional cavity space. The protruding member or batch door 380 simply moves into or away from the cavity space in order to prevent additional solid pharmaceutical products from moving toward the wedge-shaped members. The batch door 380 may be comprised of a pneumatically driven expandable bladder which when activated pushes against the solid products located adjacent to the batch door 380 in the cavity. The bladder is preferably comprised of a rubber material 381 that is located over a metal tube 382 with a slit therein that is located within the slot 375. The batch door 380 may simply move into the cavity to block any additional solid products from passing toward the wedge-shaped members.

Those skilled in the art will appreciate that a variety of different embodiments may be provided for the batch door. For example, a metal or plastic rod located within the cavity 375 can be pushed out to catch any solid pharmaceutical products.

Figure 13:
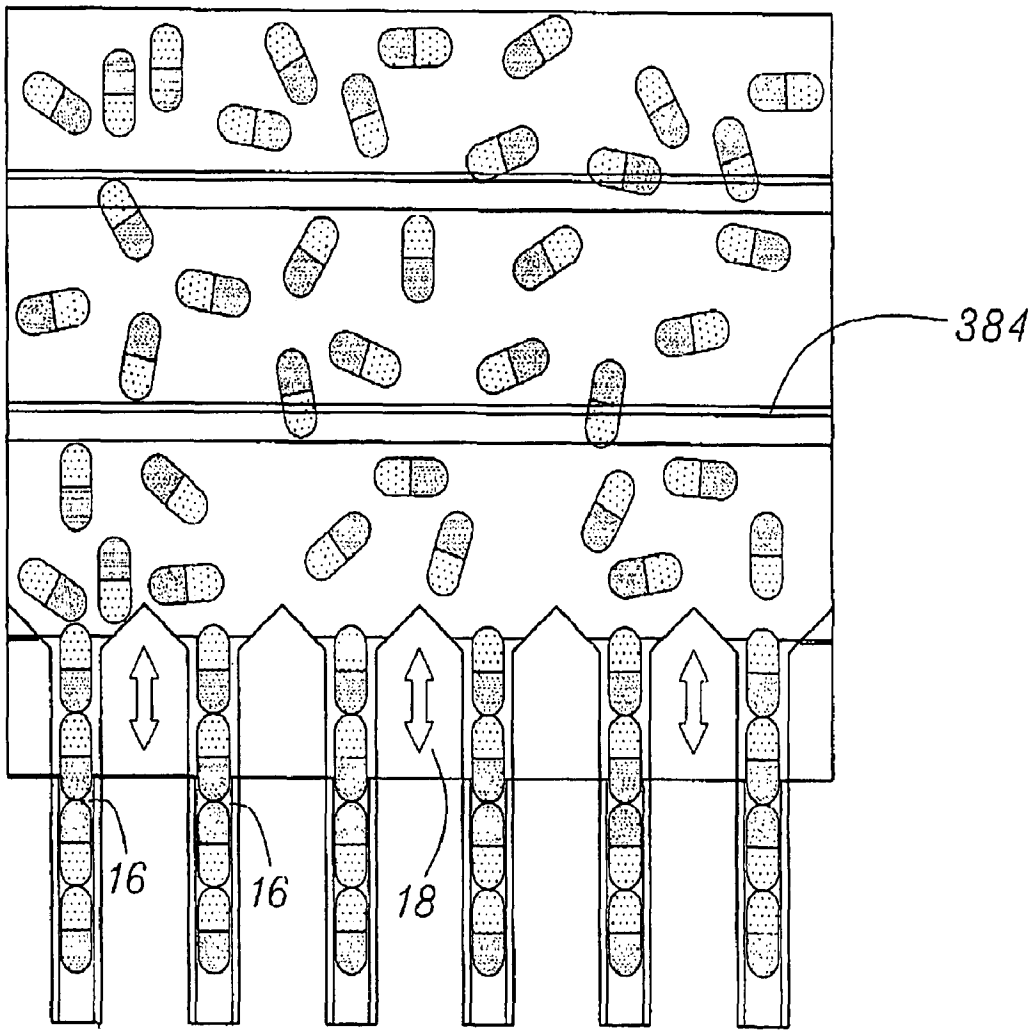
FIG. 13 illustrates operation of the three-dimensional funnel structure.

In accordance with yet another alternate aspect of the present invention, a three-dimensional funnel is provided such that two or more distinct portions define the funnel structure and at least one portion of the funnel structure is vertically displaced for the purpose of altering the three-dimensional random orientation of solid pharmaceutical products within the funnel. This approach uses the same general concept as the motion of the wedge-shaped members within the two-dimensional cavity for orienting the solid pharmaceutical products but it does not require an initial step of arranging the solid pharmaceutical products in a two-dimensional cavity. FIG. 13 illustrates an embodiment wherein the wedge-shaped members 18 are portions of three dimensional bodies defining the funnel members 18. For example, the moving portion of the funnel could be one third or one half of the overall structure. FIG. 13 also illustrates baffles 384 that prevent the solid pharmaceutical products from moving within the three-dimensional cavity.

Although not described in the provisional application upon which the instant application relies for its priority claim, the inventors of the instant application have subsequently collaborated with other individuals for the purpose of developing a convenient mechanism for arranging solid pharmaceutical products in a two-dimensional cavity. For the sake of completeness the currently contemplated structures for this mechanism are also described.

Figure 14:
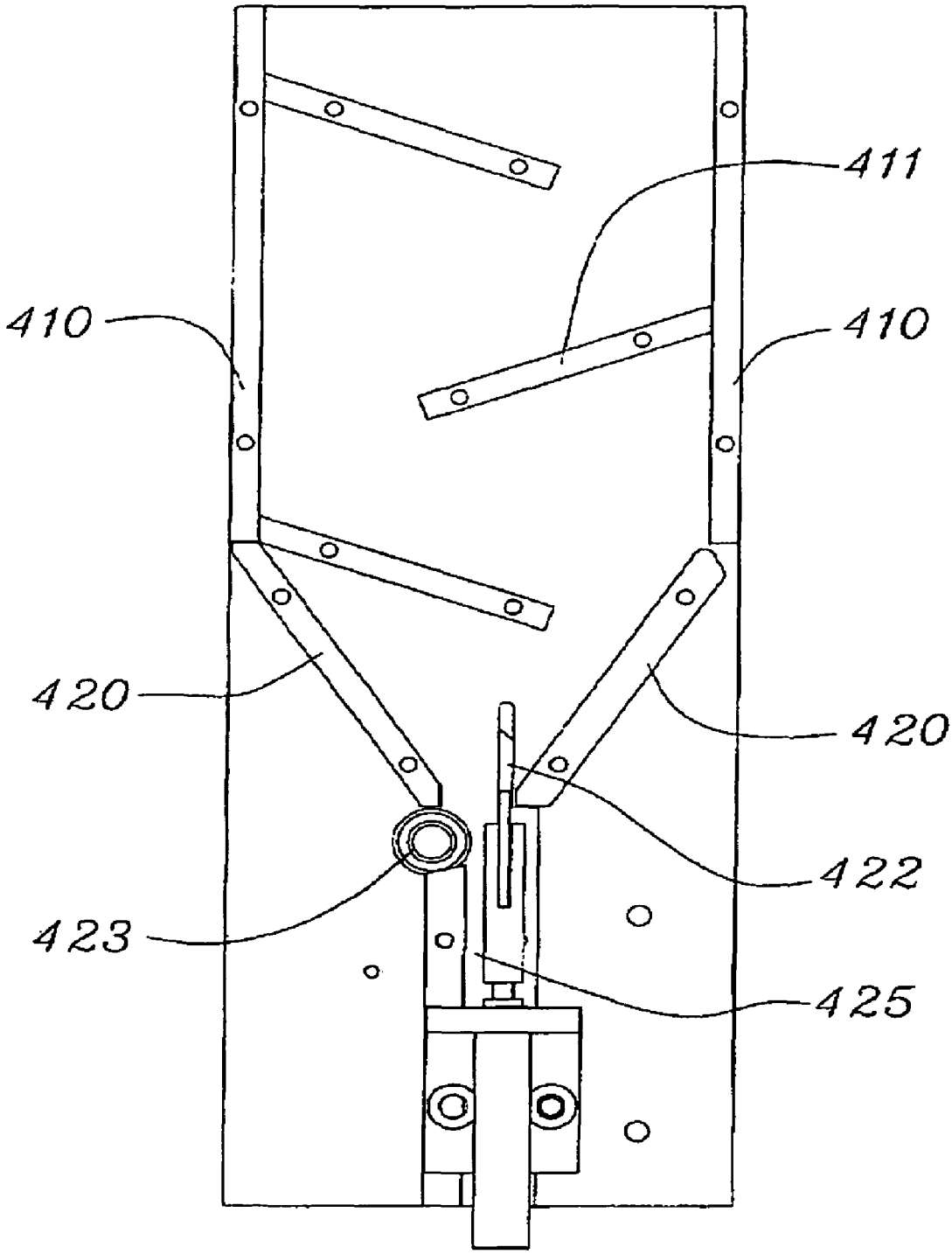
FIG. 14 illustrates a mechanism that has been jointly developed with additional inventors which illustrates an embodiment of a system for automatically orienting a three-dimensional random arrangement of solid product into a two-dimensional random orientation.

FIG. 14 illustrates a mechanism for automatically translating solid pharmaceutical or nutraceutical products from a random three-dimensional orientation into a random two-dimensional array. Sidewalls 410 define an upper three-dimensional cavity within which solid pharmaceutical or nutraceutical products are located. Buffer members 411 prevent the solid pharmaceutical products from the exerting too much downward force in the lowermost portion of the device. This arrangement aids in preventing jamming. Elongated panels 420 on opposite sides directed the solid pharmaceuticals toward a two-dimensional cavity 425. A roller 423 turns counterclockwise and kicks up any improperly oriented product members. Additionally, a vertical drive plate 422 moves upward and downward adjacent to the topmost portion of the two-dimensional cavity 425. The combination of the counterclockwise roller 423 and the vertical drive plate 422 has been found to be an efficient mechanism for altering a variety of different solid pharmaceutical products from a random three-dimensional arrangement into a two-dimensional array. For capsules and the like, the roller can be replaced by another vertical drive plate.

Figure 15:
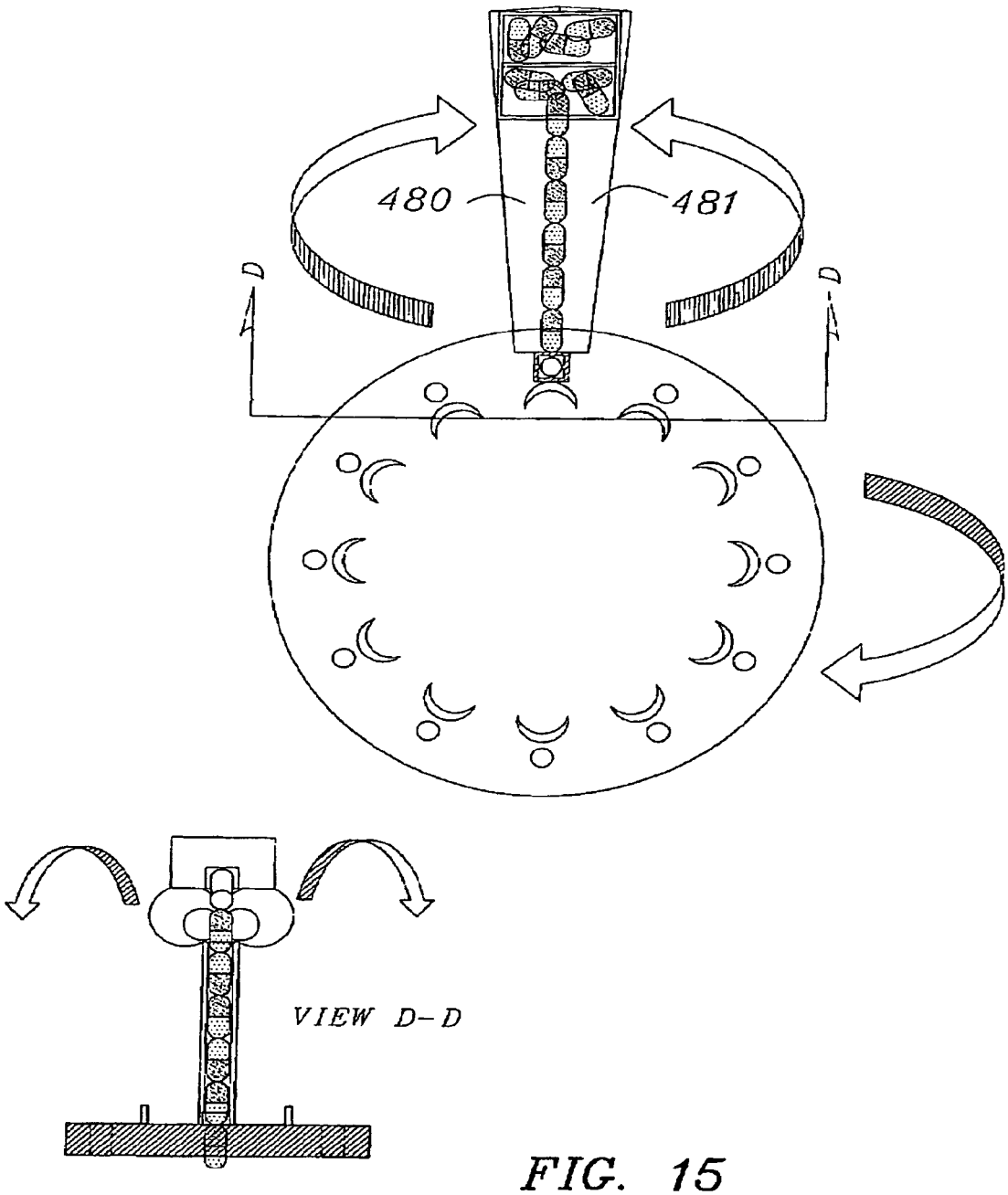
FIG. 15 illustrates an alternate embodiment for transmitting solid products into a rotating plate.

FIG. 15 shows yet another alternate embodiment wherein cone shape rollers 480, 481 direct solid pharmaceutical products into cavities that are located within the circular rotating plate 485. The rotating plate 485 preferably includes a mechanism for selectively transmitting the solid products away from the rotating plate. For example, the escapement mechanisms described above are suitable for this purpose. The half-moon shaped structures are protrusions secured to the rotating plate which are intended to contact the triggering mechanism actuator described above so that the escapement mechanism is triggered at the desired point of rotation.

In the embodiments described above, the angle for the side of each wedge-shaped member is approximately 30° to 45° measured from the perpendicular along a side of the wedge member. It is presently preferred that the wedge shaped members are displaced approximately one half of an inch for a long capsule and 0.4 of an inch for a smaller tablet. The spacing between the panels is a few percent larger than the diameter of the pills in the desired orientation. Each spring preferably has three to five coils of pitch per tablet length in the desired orientation.

We claim:

1. A system for selectively transferring a series of individual solid consumable products from a two-dimensional arrangement of the three-dimensional products comprising:

a cavity containing only a two-dimensional random arrangement of a plurality of the solid consumable products, wherein two substantially parallel side walls define the cavity which are separated from one another by a distance which is slightly larger than a greatest dimension of the solid products in a desired orientation between the side walls;

a solid product passageway located beneath the cavity; and a solid consumable product alignment member having two sides defining a shape that gradually increases in width from a location protruding furthest into the cavity toward a portion closest to the solid product passageway, and wherein the solid product alignment member moves upward and downward in the cavity to orient the solid consumable products such that the products pass into the passageway and wherein the solid consumable product alignment member has a thickness which enables the alignment member to freely move into the cavity, the solid consumable product alignment member primarily moving up and down in the cavity without substantial horizontal displacement, and further wherein the solid consumable product alignment member moves up and down between the substantially parallel side walls which define the cavity, wherein each side of the solid consumable product alignment member directs consumable products to a different solid product passageway.

2. A system for selectively transmitting a plurality of consumable products into product package locations according to claim 1, wherein the solid consumer product alignment member is comprised of a triangular structure.

3. A system for selectively transmitting a plurality of consumable products into product package locations according to claim 1, wherein the two-dimensional cavity is defined by at least one clear panel member.

4. A system for selectively transmitting a plurality of consumable products into product package locations according to claim 1, wherein at least a portion of the solid consumer product alignment member moves upward and downward to reorient the solid products.

5. A system for selectively transmitting a plurality of consumable products into product package locations according to claim 1, further comprising a consumable product selective transmission mechanism located beneath each solid product path.

6. A system for selectively transmitting a plurality of consumable products into product package locations according to claim 1, further comprising a spring within which the solid consumable products are arranged after passing through the path.

7. A system for selectively transmitting a plurality of consumable products into product package locations according to claim 6, further comprising a spring vibrator located adjacent to the spring.

8. A system for selectively transmitting a plurality of consumable products into product package locations according to claim 1, further comprising a motor which selectively drives a portion of the solid consumer product alignment member upward or downward.

9. A system for selectively transmitting a plurality of consumable products into product package locations according to claim 8, wherein the motor also causes vibration of a spring through which the solid consumable products pass.

10. A system for selectively transmitting a plurality of consumable products into product package locations according to claim 1, further comprising a motor that rotates a drive shaft having a plurality of cam members that rotate and drive at least a portion of the solid consumer product alignment member against a spring with a vertical component of motion.

* * * * *